US005123501A

United States Patent [19]

Rothman et al.

[11] Patent Number: 5,123,501

[45] Date of Patent: Jun. 23, 1992

[54] IN-LINE CONSTRICTED SOUND-ATTENUATING SYSTEM

[75] Inventors: James C. Rothman, Burnsville; Charles O. Reinhart, Minneapolis; Donald R. Monson, West St. Paul, all of Minn.

[73] Assignee: Donaldson Company, Inc., Minneapolis, Minn.

[21] Appl. No.: 260,818

[22] Filed: Oct. 21, 1988

[51] Int. Cl.[5] ..... F01N 7/00

[52] U.S. Cl. ..... 181/239; 181/227; 181/264; 181/269

[58] Field of Search ..... 181/247, 227, 264, 269, 181/272, 239

[56] References Cited

U.S. PATENT DOCUMENTS

| | | | |
|---|---|---|---|
| 794,226 | 7/1905 | Ihrig et al. | 181/239 X |
| 910,192 | 1/1909 | Grouvelle . | |
| 1,342,340 | 6/1920 | Martin . | |
| 1,454,986 | 5/1923 | Thomas . | |
| 1,611,475 | 12/1926 | Maxim | 181/249 |
| 1,760,924 | 6/1930 | Watkins . | |
| 1,777,522 | 10/1930 | Hamilton et al. . | |
| 1,811,762 | 6/1931 | Schnell . | |
| 1,835,053 | 12/1931 | Huebyn . | |
| 1,881,051 | 10/1932 | Haas . | |
| 1,922,848 | 8/1933 | Harley . | |
| 1,934,462 | 11/1933 | Hartsock . | |
| 1,993,397 | 3/1935 | Berg et al. . | |
| 2,019,697 | 11/1935 | Smith | 181/251 X |
| 2,023,024 | 12/1935 | Kittell . | |
| 2,055,453 | 9/1936 | Horton . | |
| 2,233,327 | 2/1941 | Sauer . | |
| 2,248,456 | 7/1941 | Harris . | |
| 2,391,863 | 1/1946 | Bowen . | |
| 2,512,155 | 6/1950 | Hill | 181/249 |
| 2,629,455 | 2/1953 | Cushman . | |
| 2,671,523 | 3/1954 | Walker . | |
| 2,764,250 | 9/1956 | Jeffords . | |
| 2,838,128 | 6/1958 | Kliewer, Sr. . | |
| 3,043,097 | 7/1962 | Inman et al. . | |
| 3,104,736 | 9/1963 | Ludlow et al. . | |
| 3,112,007 | 11/1963 | Ludlow et al. . | |
| 3,112,008 | 11/1963 | Ludlow . | |
| 3,114,432 | 12/1963 | Ludlow et al. . | |
| 3,118,517 | 1/1964 | Ludlow et al. . | |
| 3,119,459 | 1/1964 | Ludlow et al. . | |
| 3,128,841 | 4/1964 | Ludlow et al. . | |
| 3,146,850 | 9/1964 | Ludlow et al. . | |
| 3,146,851 | 9/1964 | Ludlow et al. . | |
| 3,167,152 | 1/1965 | Ludlow et al. . | |
| 3,176,790 | 4/1965 | Lentz . | |
| 3,219,142 | 11/1965 | Deremer . | |

(List continued on next page.)

FOREIGN PATENT DOCUMENTS

| | | |
|---|---|---|
| 561067 | 10/1932 | Fed. Rep. of Germany . |
| 172450 | 8/1960 | Sweden . |
| 2070682 | 9/1981 | United Kingdom . |

OTHER PUBLICATIONS

"Arvi Node in Production", (source unknown).

"Walker Shows New Exhaust System", *Newsletter*.

"The Chambered Pipe Silencing Concept of Exhaust System Design", John C. Walker and Ervin C. Lentz, Automobile Week, Mar. 30–Apr. 3, 1964.

Derwent's abstract, No. 86- 53 693/08, SU 1 170 181, publ. week 8608 (UFA Aviation Inst), 1983.

*Primary Examiner*—Benjamin R. Fuller
*Assistant Examiner*—David Yockey
*Attorney, Agent, or Firm*—Merchant & Gould, Smith, Edell, Welter & Schmidt

[57] ABSTRACT

A sound attenuating device is provided for attenuating noise in an exhaust system. The attenuating device includes an inlet end, an outlet end and a constricted portion therebetween. In use, the attenuating device may be disposed in a tubular housing or may be an integral portion of a tail pipe, connecting pipe, or muffler. Further, a sound suppressing system is described including one or more attenuating regions including attenuating devices. The attenuating regions are spaced to attenuate desired frequencies. Expansion chambers formed between attenuating regions contribute to sound suppression.

1 Claim, 28 Drawing Sheets

U.S. PATENT DOCUMENTS

| | | | |
|---|---|---|---|
| 3,289,785 | 12/1966 | Walker . | |
| 3,292,731 | 12/1966 | Ballard . | |
| 3,335,813 | 8/1967 | Kelley . | |
| 3,348,629 | 10/1967 | Cassel . | |
| 3,396,812 | 8/1968 | Wilcox et al. . | |
| 3,419,892 | 12/1968 | Wagner et al. . | |
| 3,500,954 | 3/1970 | Willette . | |
| 3,593,499 | 7/1971 | Kile . | |
| 3,672,464 | 6/1972 | Rowley et al. | 181/253 |
| 3,702,144 | 11/1972 | Toulland . | |
| 3,776,364 | 12/1973 | Van Doeren . | |
| 3,857,458 | 12/1974 | Ohtani et al. . | |
| 3,955,643 | 5/1976 | Clark . | |
| 4,113,051 | 9/1978 | Moller . | |
| 4,142,606 | 4/1979 | Vanderzanden et al. | 181/231 |
| 4,147,230 | 4/1979 | Ormond et al. | 181/231 |
| 4,226,298 | 10/1980 | Bancel et al. | 181/226 |
| 4,228,868 | 10/1980 | Raczuk | 181/247 |
| 4,263,982 | 4/1981 | Feuling | 181/256 |
| 4,267,899 | 5/1981 | Wagner et al. | 181/272 |
| 4,298,088 | 11/1981 | Keller | 181/211 |
| 4,325,459 | 4/1982 | Martin | 181/248 |
| 4,325,460 | 4/1982 | Hoppenstedt | 181/259 |
| 4,348,862 | 9/1982 | Fujikawa et al. | 60/314 |
| 4,361,206 | 11/1982 | Tsai | 181/255 |
| 4,368,799 | 1/1983 | Wagner | 181/255 |
| 4,388,804 | 6/1983 | Bushmeyer | 60/319 |
| 4,580,657 | 4/1986 | Schmeichel et al. | 181/255 |
| 4,632,216 | 12/1986 | Wagner et al. | 181/255 |
| 4,690,245 | 9/1987 | Gregorich et al. | 181/272 |

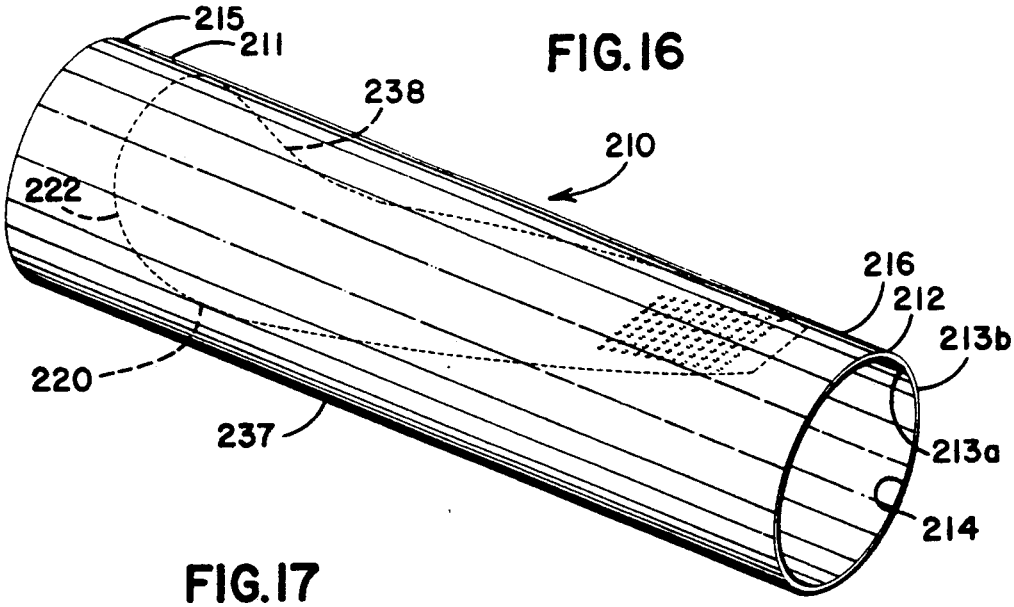
FIG.16
FIG.17
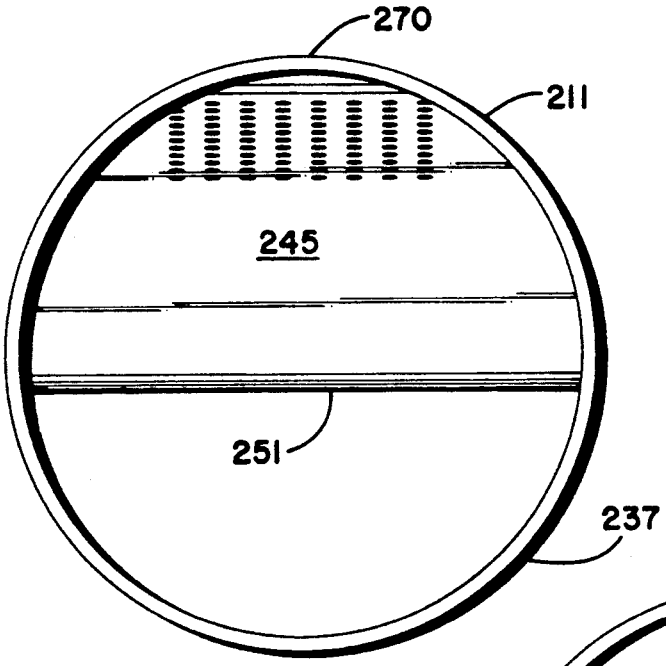
FIG.18
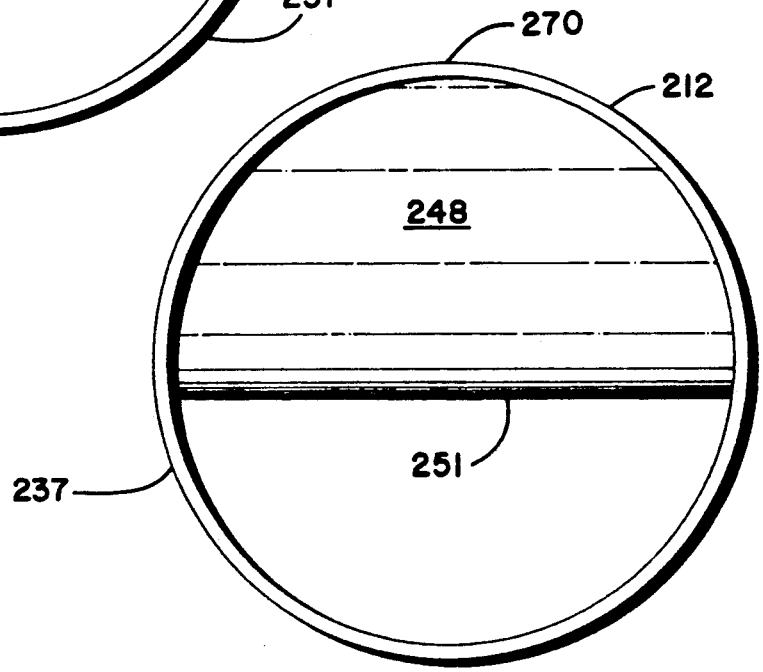

FIG.25
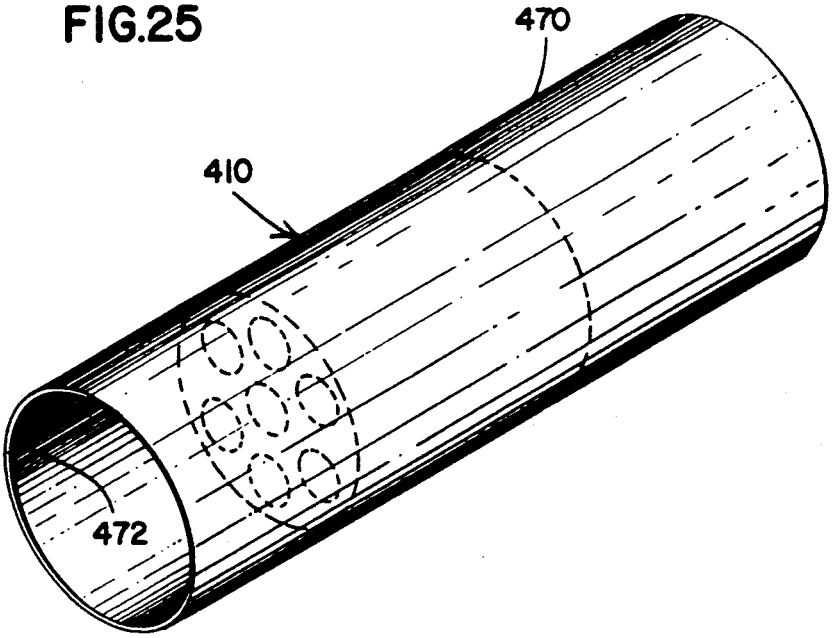
FIG.26
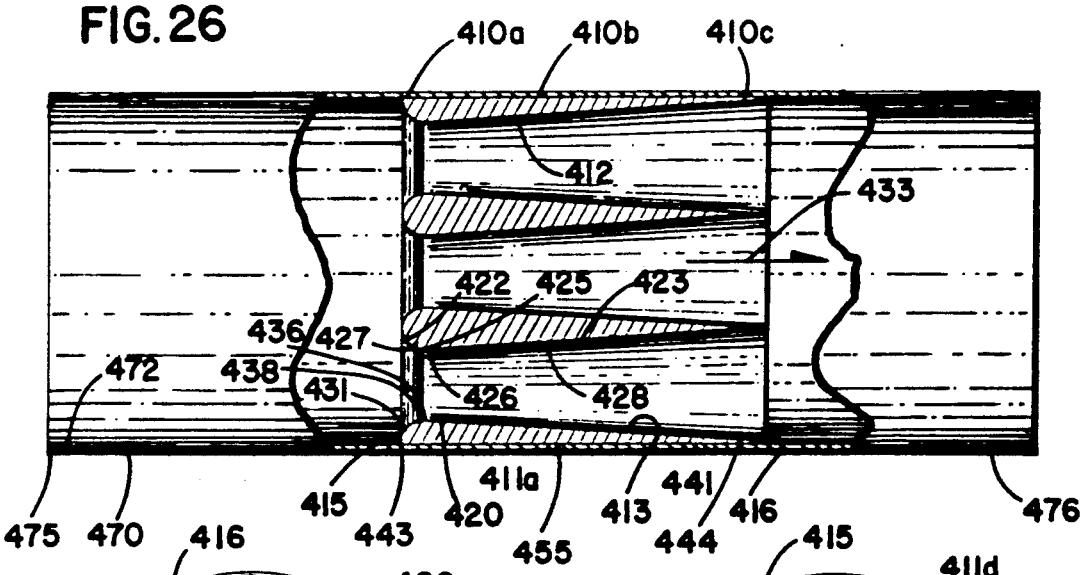
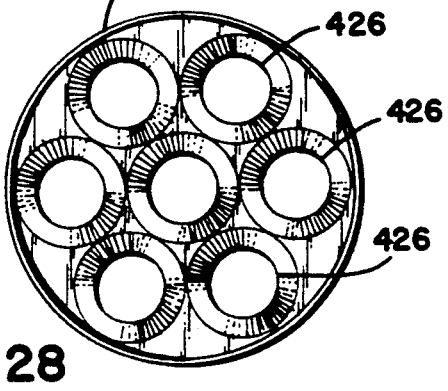
FIG.28
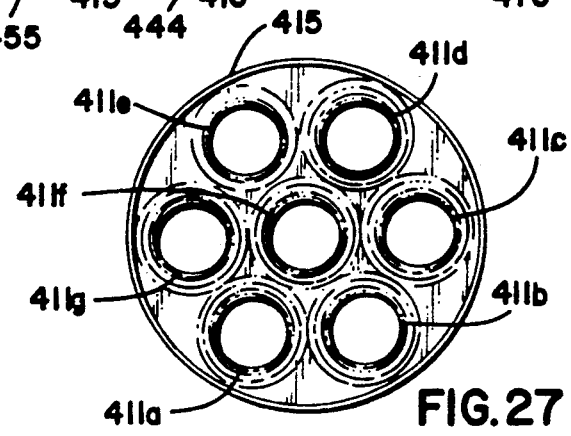
FIG.27

FIG. 53
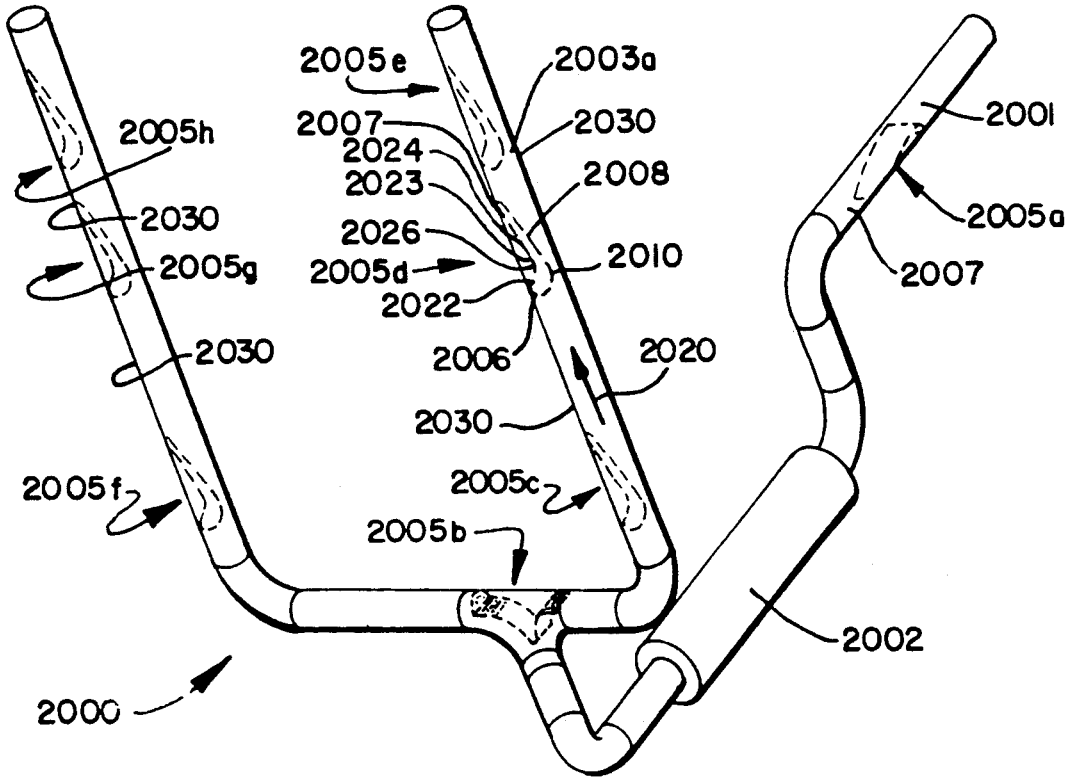
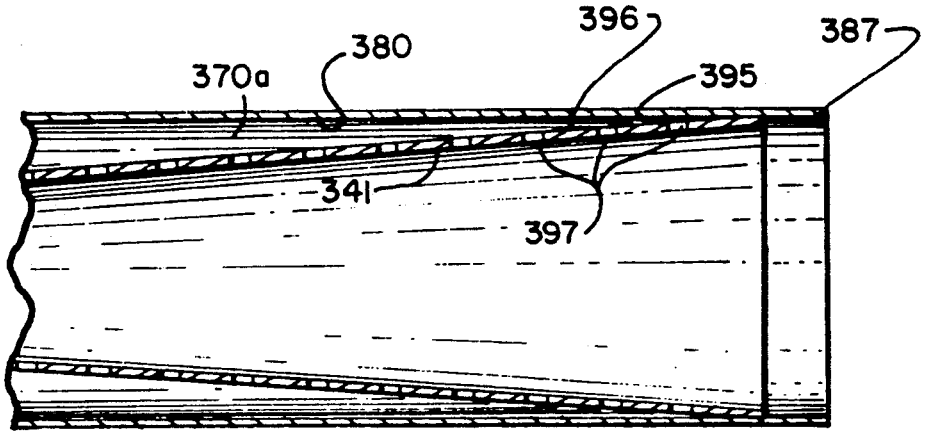
FIG. 24 A

IN-LINE CONSTRICTED SOUND-ATTENUATING SYSTEM

TECHNICAL FIELD

The present invention relates to a constricted tube structure which may be used as part of a device for sound suppression, such as a muffler, tail pipe or connecting pipe.

BACKGROUND OF THE INVENTION

Typical vehicle exhaust systems include an exhaust pipe, a muffler, and a tail pipe. In prior systems, acoustic attenuation, or sound suppression, is substantially performed by the muffler, while the connecting pipe and the tail pipe serve primarily to transport the exhaust gas. These pipes are typically cylindrical tubes of constant cross-sectional area and may include an elbow bend or a T-shaped intersection. In some instances, the pipes themselves may add to the noise problem by creating standing waves and undesirable resonances.

Generally, a muffler's attenuating influence is related to its length and diameter; the larger a muffler is, the greater its attenuating influence. To attenuate low frequency noise, such as that produced in a truck exhaust system, a muffler must be relatively long.

Relatively long or large mufflers, however, are disadvantageous for many reasons. Long or large mufflers require a relatively large amount of steel to manufacture and therefore are relatively expensive to produce. They are relatively heavy and cumbersome and therefore relatively difficult to install and support. Perhaps most significant is that the vehicle must include a relatively large space dedicated to a relatively large muffler, thus necessitating redesign of engine placement and body design to accommodate.

One highly effective means of suppressing sound is the employment of an apparatus including a venturi contained within a housing. Such an apparatus is shown in U.S. Pat. No. 4,580,657.

It would be desirable to produce a venturi-like sound attenuating element of a reasonable size, which has relatively good sound suppression characteristics. Further, it would be desirable to create attenuating elements capable of serving as tail pipe or connecting pipe sections thus requiring less attenuating at the muffler to achieve a given attenuation which is distributed through the system as a whole.

SUMMARY OF THE INVENTION

The present invention is directed to a sound-suppressing system including at least one sound-suppressing device having inlet and outlet ends and a constricted portion therebetween.

According to another aspect of this invention, the constricted portion has a cross-sectional area at one end substantially similar to the inlet cross-sectional area. The constricted portion cross-sectional area decreases relatively rapidly to a minimum area at a point of maximum constriction and, downstream of the constriction, increases more gradually to an area substantially similar to the outlet cross-sectional area.

According to a another aspect of the invention, the constricted portion includes an angular bend.

According to another aspect of this invention, the sound-suppressing device includes a tubular attenuating element within a tubular housing.

According to a further aspect of this invention, the tubular attenuating element includes an constricting member suspended within a tubular housing, where the housing may be an attenuating element.

According to a further aspect of the invention, one or more tubular attenuating elements may be employed in a sound suppressing device, wherein the attenuating elements are arranged in series and spaced for optimal sound suppression.

The specifications and drawings disclose numerous embodiments. However, the invention is characterized in the claims annexed hereto and forming a part hereof. For a better understanding of the invention, its advantages and objects obtained by its use, reference should be made to the drawings and accompanying descriptive matter.

BRIEF DESCRIPTION OF THE DRAWINGS

FIG. 16 is a perspective view of an alternate embodiment of an attenuating element;

FIG. 17 is an outlet end view as seen from the right end of the element in FIG. 16;

FIG. 18 is an inlet end view as seen from the left end of the element in FIG. 16;

FIG. 24A is a side elevational view of an alternate embodiment of an attenuating element;

FIG. 25 is a perspective view of an alternate embodiment of an attenuating element disposed in a housing;

FIG. 26 is a cut-away, cross-sectional view taken along lines 26—26 of FIG. 25;

FIG. 28 is an inlet end view of the attenuating element in FIG. 26;

FIG. 27 is an inlet end view as seen from the left end of the element in FIG. 26;

FIG. 28 is an outlet end view as seen from the right end of the element in FIG. 26;

FIG. 53 is a perspective view of a sound suppression system, with attenuating elements in hidden.

DETAILED DESCRIPTION OF THE INVENTION

Figure 1:
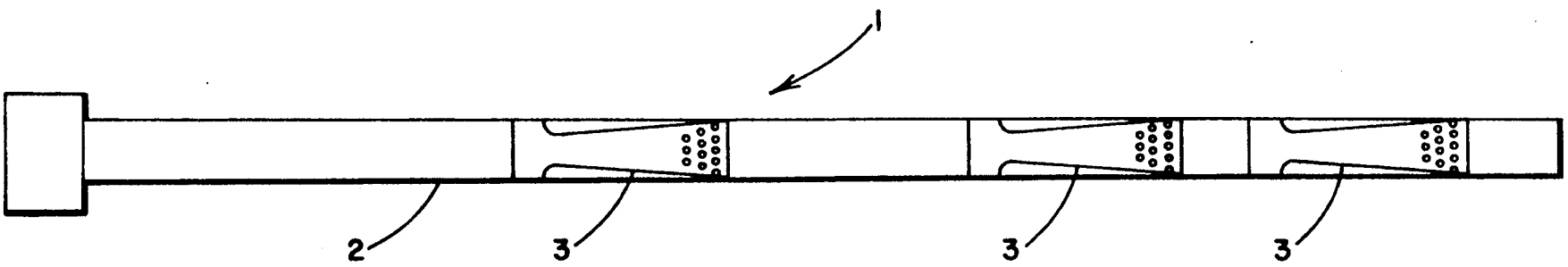
FIG. 1 is an axial sectional view of a preferred sound suppressing system including sound attenuating elements according to the invention.
Figure 2:
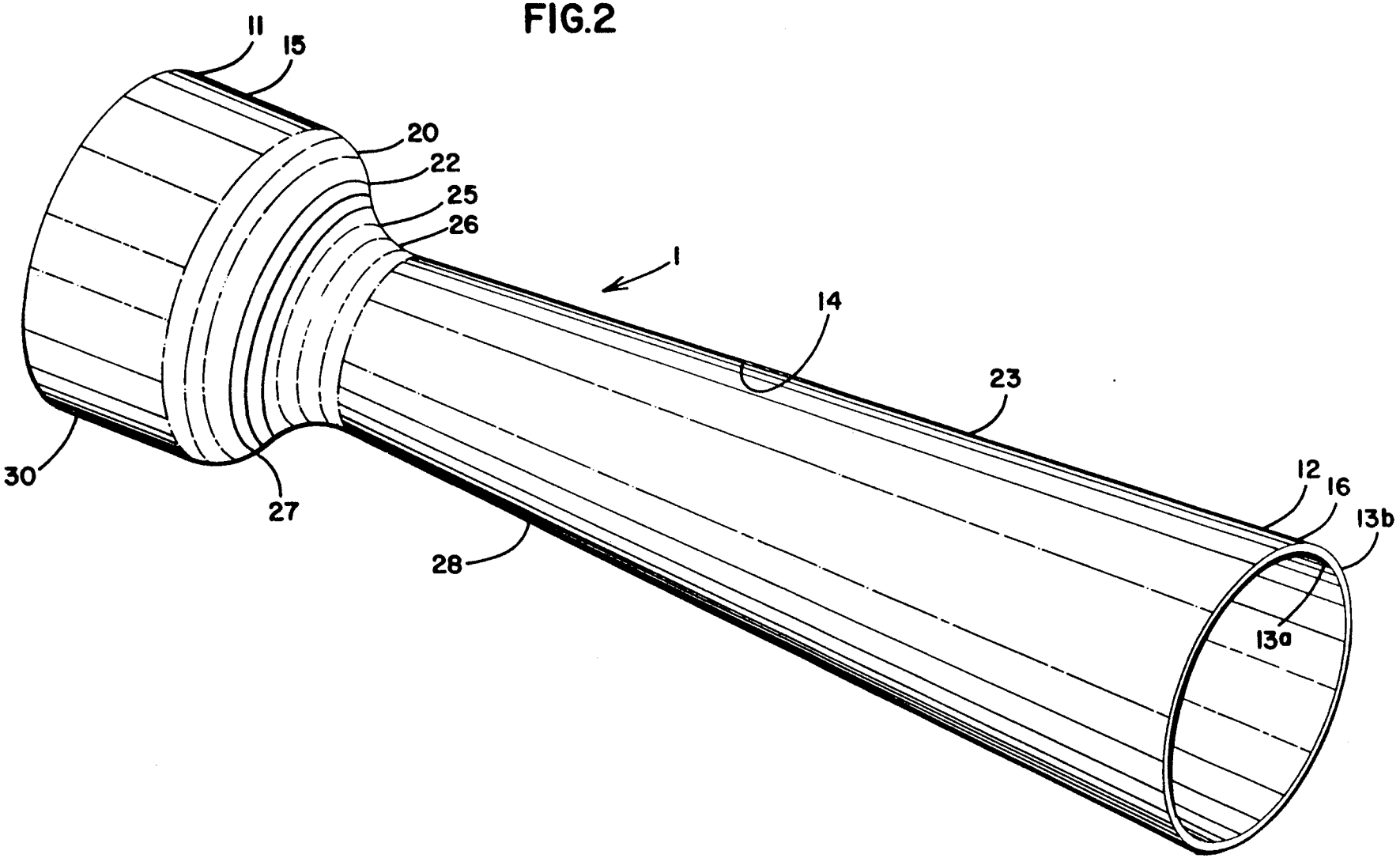
FIG. 2 is a perspective view of one embodiment of an attenuating element.
Figure 3:
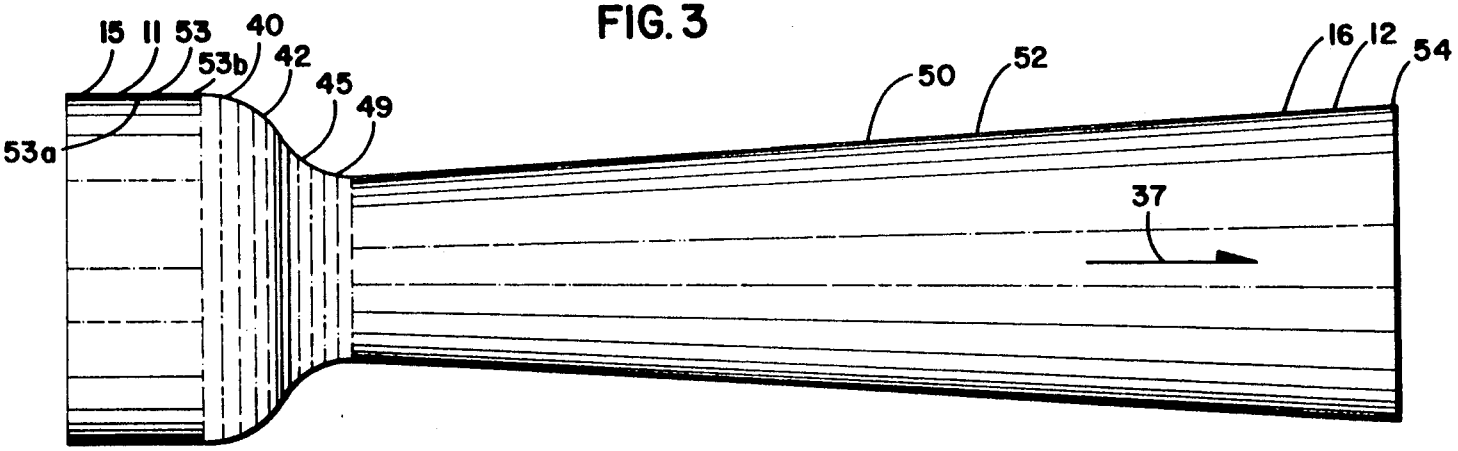
FIG. 3 is a side elevational view of the attenuating element in FIG. 2.
Figure 5:
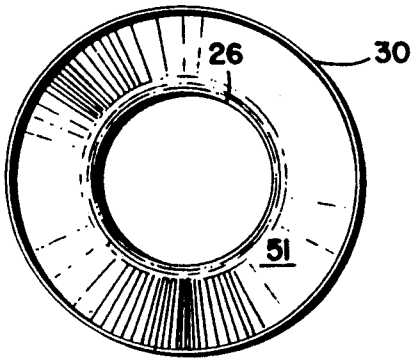
FIG. 5 is an outlet end view as seen from the right end of the attenuating element in FIG. 2.
Figure 4:
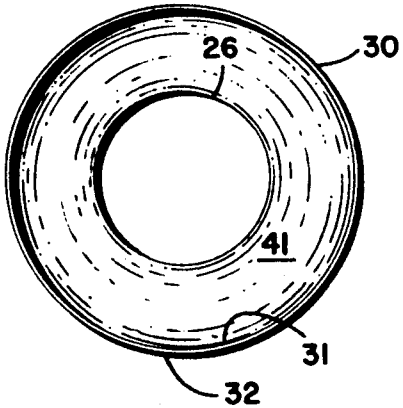
FIG. 4 is an inlet end view as seen from the left end of the attenuating element in FIG. 2.

To aid in the understanding of the present invention as used for sound suppression in an exhaust system, FIG. 1 shows an overall view of a sound suppression system 1, including a pipe section 2 incorporating constricted attenuating members 3. The pipe section 2 may be a portion of a connecting pipe, a tail pipe, or a muffler. Attenuating member 3 may be integral with the pipe section 2 or may be suspended therein, as shown in FIG. 1. Further description of a sound suppression system 1 emplying one or more embodiments of constricted attenuating members 3 follows a description of the preferred and alternate embodiments of the constricted attenuating member 3 below.

I. CIRCULAR RESONATOR EMBODIMENT

A first embodiment of a constricted attenuating member 3 is a circular attenuating member 10, shown in FIGS. 2–9. Circular attenuating member 10 has an inlet end 11 and an outlet end 12, and includes an inner surface 13*a* and an outer surface 13*b*. Inner surface 13*a* defines a channel 14 and has a first end portion 15, a second end portion 16, and a constricted portion 20 therebetween. Constricted portion 20 includes a converging portion 22, a diverging portion 23, and a throat portion 25, therebetween. Throat portion 25 has a generally circular periphery and includes a point of greatest constriction 26.

Converging portion 22 is characterized by a region of rapidly decreasing throat cross-sectional area 27, where the cross-sectional area decreases in the direction from first end portion 15 to the point of greatest constriction 26. Diverging portion 23 is characterized by a region of gradually increasing cross-sectional area 28 where the cross-sectional area increases in the direction from the point of greatest constriction 26 toward second end portion 16. The terms "rapid" and "gradual", as used throughout, are relative terms with respect to each other.

First end portion 15 includes a tubular member 30 having an inner surface 31 and an outer surface 32. Inner surface 31 is generally cylindrical; that is, inner surface 31 is generally circular in cross-section with a constant diameter 35 along the length of inner surface 31 in the direction indicated by arrow 37. (Arrow 37 designates the general direction of flow of a fluid through the attenuating member 10, as will be discussed below.) Outer surface 32 is also generally cylindrical and parallel to inner surface 31; that is, outer surface 32 is generally circular in cross-section with a constant diameter 39 along the length of outer surface 32 in the direction indicated by arrow 37.

Converging portion 22 includes a tubular member 40 having an inner surface 41 and an outer surface 42. Inner surface 41 is convexly curved; that is, inner surface 41 is generally circular in cross section, with a relatively rapidly decreasing diameter along the length of inner surface 41 in the direction indicated by arrow 37. Outer surface 42 is generally parallel to inner surface 41; that is, outer surface 42 is generally circular in cross-section with a relatively rapidly decreasing diameter along the length of outer surface 42 in the direction indicated by arrow 37.

Throat portion 25 includes a tubular member 45 having an inner surface 46 and an outer surface 47. Inner surface 46 is generally circular in cross section and includes a region 48 of least cross-sectional area. Similarly, outer surface 47 is generally circular in cross section and includes a region 49 of least cross-sectional area.

Diverging portion 23 similarly includes a tubular member 50 having an inner surface 51 and an outer surface 52. Inner surface 51 is generally conical; that is, inner surface 51 is generally circular in cross-section with a relatively gradually increasing diameter along the length of inner surface 51 in the direction indicated by arrow 37. Outer surface 52 is generally parallel to inner surface 61 and therefore is generally conical; that is, outer surface 52 is generally circular in cross-section with a relatively gradually increasing diameter along the length of outer surface 52 in the direction indicated by arrow 37.

In the preferred circular attenuating member 10, converging portion 22 includes a point 53 of greatest cross-sectional area. Converging portion inner surface 41 includes a corresponding point 53*a* of greatest cross-sectional area; similarly, converging portion outer surface 42 includes a corresponding point 53*b* of greatest cross-sectional area.

Diverging portion 23 includes a point 54 of greatest cross-sectional area. Diverging portion inner surface 51 includes a corresponding point 54*a* of greatest cross-sectional area; similarly, diverging portion outer surface 52 includes a corresponding point 54*b* of greatest cross-sectional area. Preferably, point 54*b* has a cross-sectional area which may be less the cross-sectional area of point 53*b*.

Preferred converging portion 22 converges at an angle or slope generally greater than the angle or slope at which the diverging portion 23 diverges. Angle, as used throughout, is synonymous with slope. Diverging portion 23 diverges at an angle or slope less than that which produces flow separation, which is generally between about 7° and 14°; that is, an angle 56 of between 3.5° and 7° is defined between diverging portion 23 and longitudinal axis 57. It should be noted that angles as specified throughout are preferable for use in many exhaust systems; the angle required to optimize attenuation may vary according to the exhaust system in which the element is used, and therefore the range of angles specified should not be considered limiting.

Figure 6:
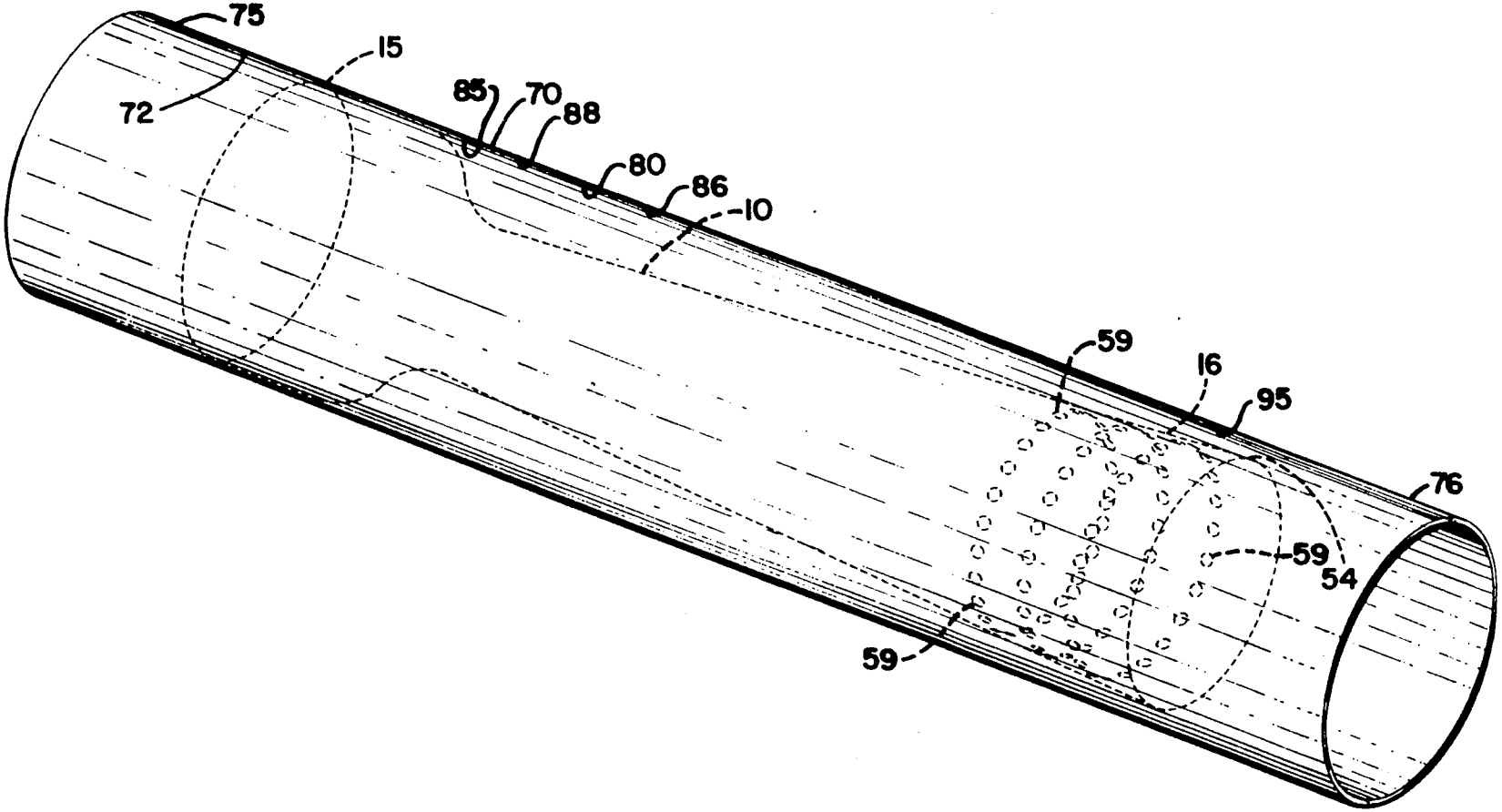
FIG. 6 is a perspective view of an alternate embodiment of an attenuating element disposed in a tubular housing.
Figure 7:
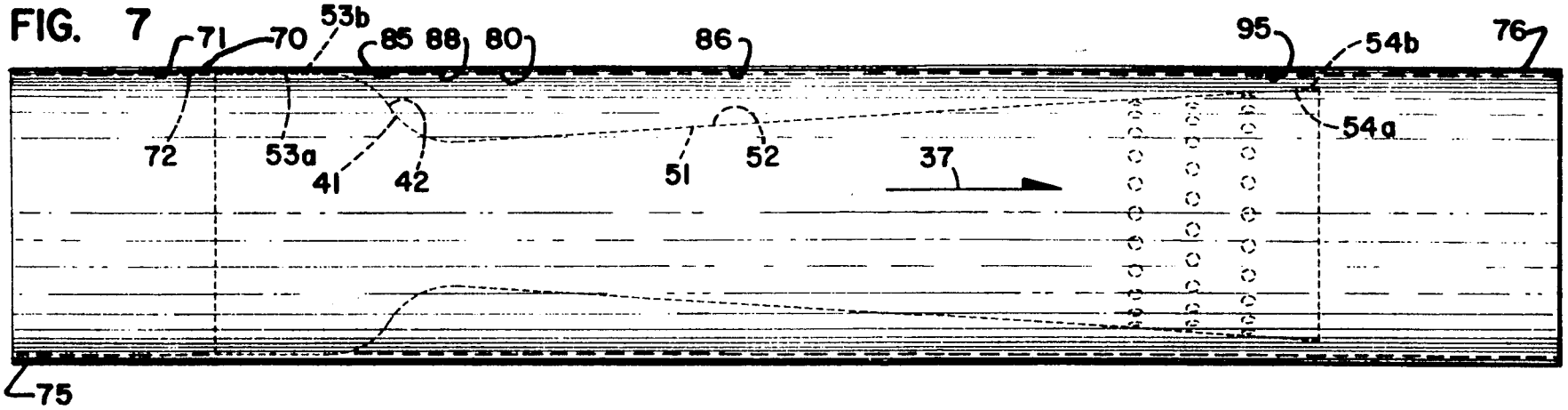
FIG. 7 is a side elevational view of the attenuating element in FIG. 6.
Figure 9:
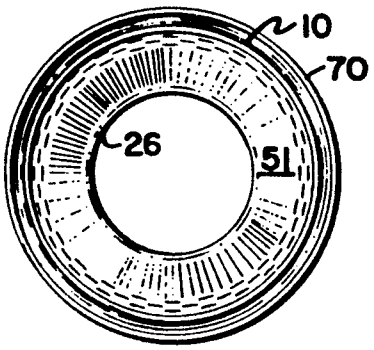
FIG. 9 is an outlet end view as seen from the right end of the tube in FIG. 6.
Figure 8:
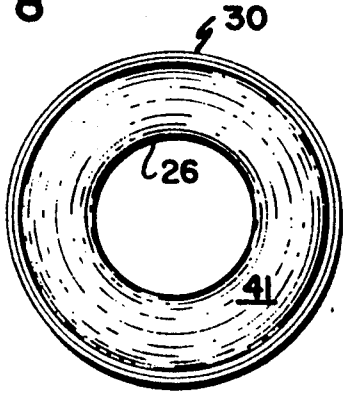
FIG. 8 is an inlet end view as seen from the left end of the tube in FIG. 6.
Figure 10:
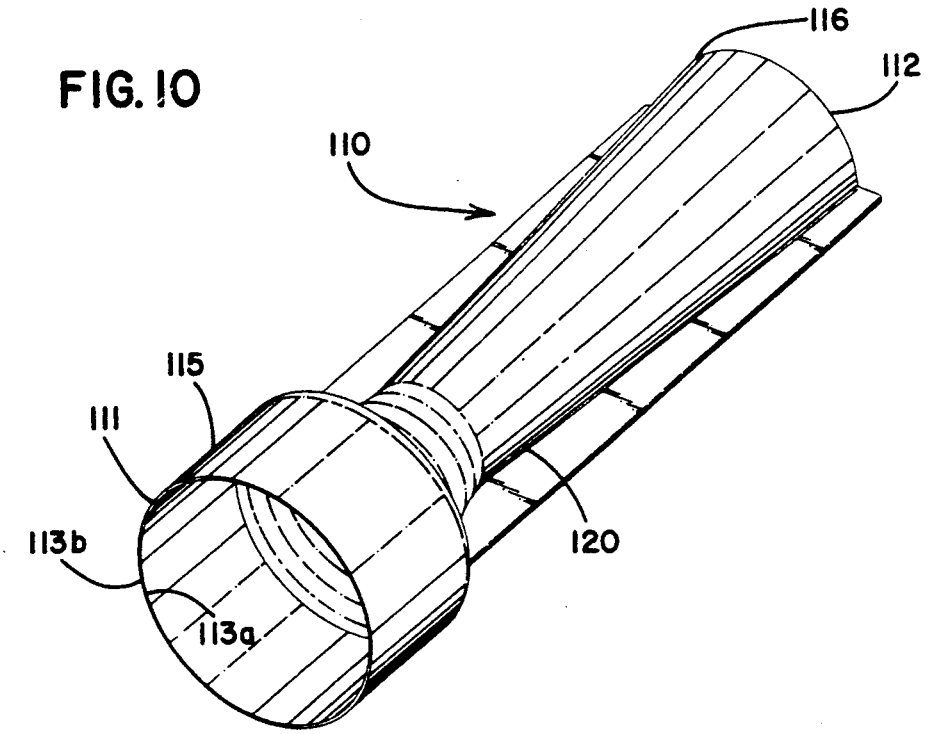
FIG. 10 is a perspective view of an alternate embodiment of an attenuating element.
Figure 11:
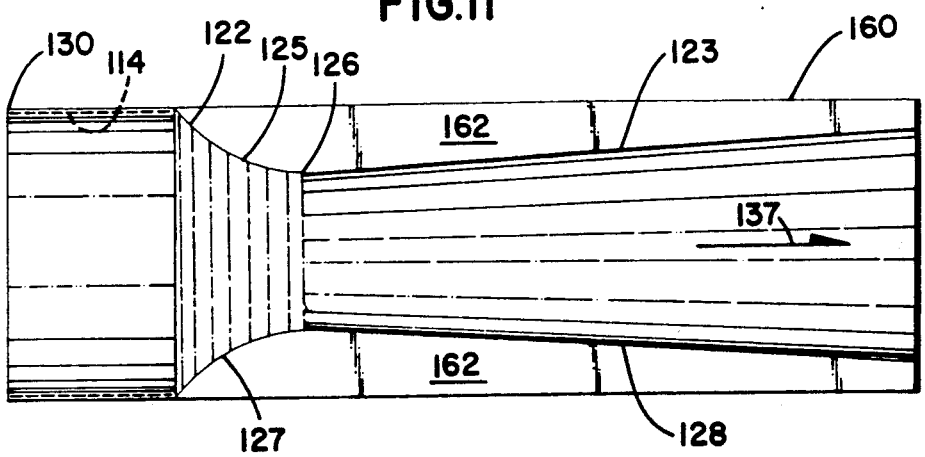
FIG. 11 is a top elevational view taken along line 11—11 of FIG. 10.
Figure 12:
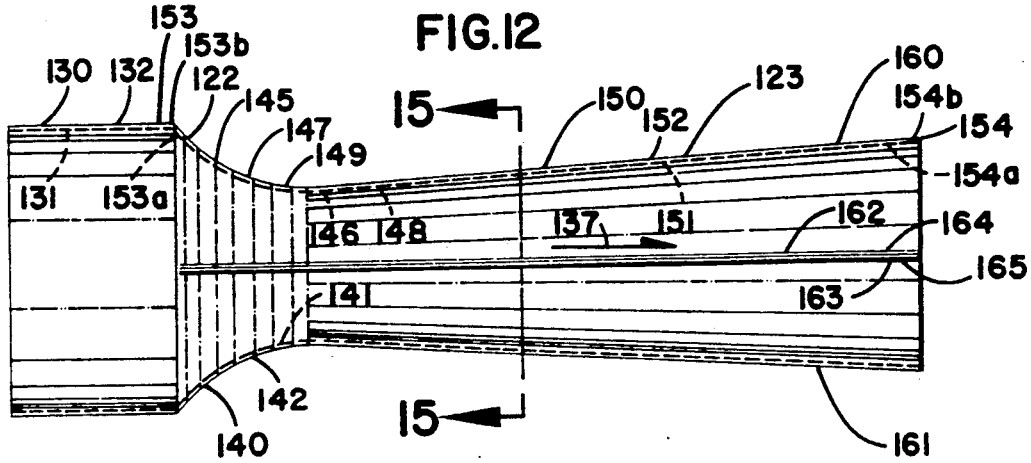
FIG. 12 is a side elevational view of the embodiment of an attenuating element shown in FIG. 10.
Figure 13:
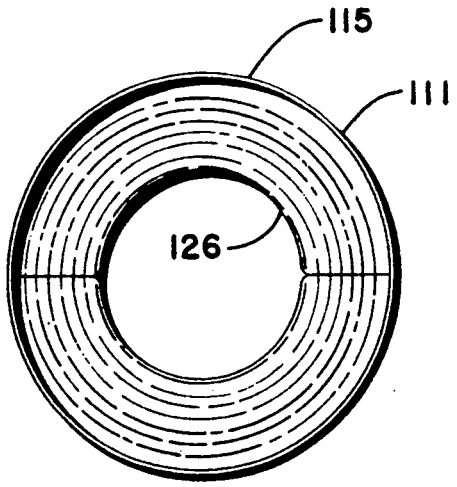
FIG. 13 is an inlet end view as seen from the left end of the element shown in FIG. 10.
Figure 14:
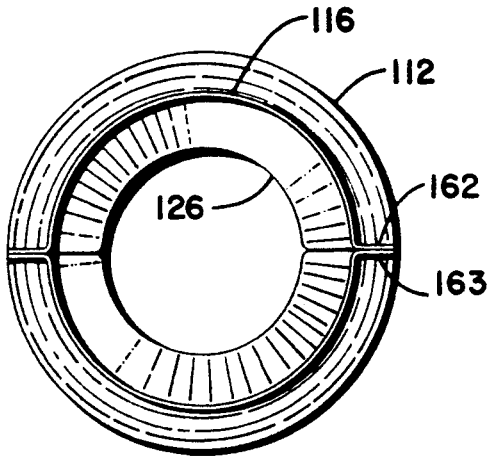
FIG. 14 is an outlet end view as seen from the right end of the element of FIG. 10.
Figure 15:
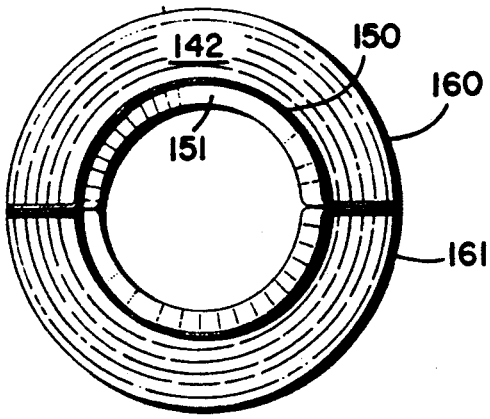
FIG. 15 is a cross-sectional view taken along line 15—15 of FIG. 12.
Figure 19:
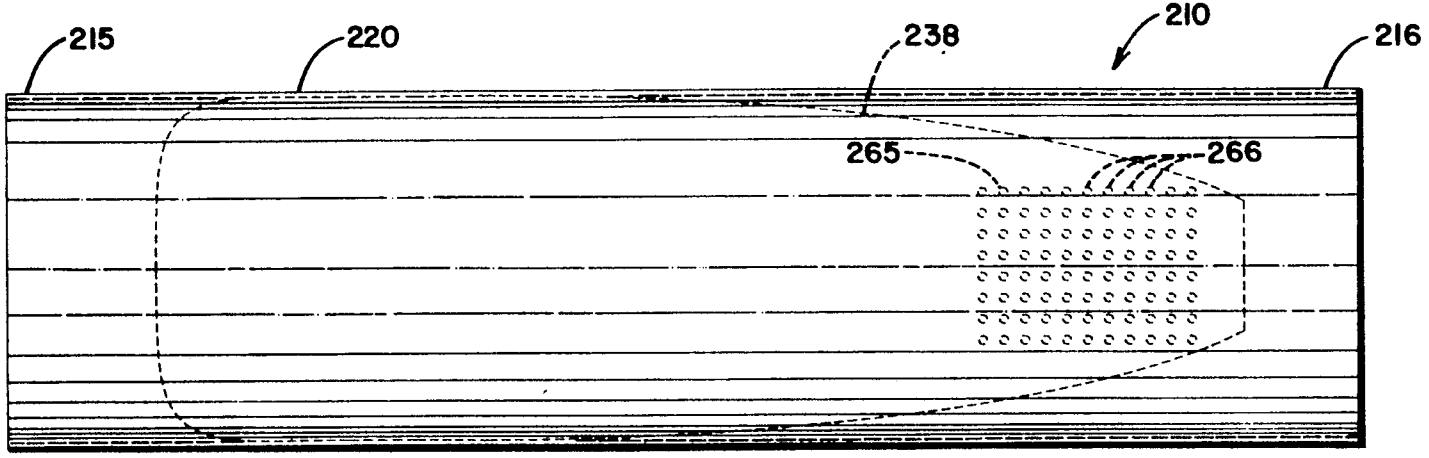
FIG. 19 is an elevational view of the element shown in FIG. 16.

Preferably, second end portion 16 includes a perforated portion 58 having perforations 59 as shown in FIGS. 6 and 7. Perforations 59 may be generally circular and may be arranged in rings 59*a* about diverging portion 23 generally proximate second end portion 16.

In typical use, the attenuating member 10 with perforations 56 is suspended in a tubular housing section 70 of an exhaust system as shown in FIGS. 6–9. Tubular section 70 defines a channel portion 71 and may be a portion of a tail pipe, an exhaust pipe, or a muffler. Tubular section 70 includes an inlet portion 75 and an outlet portion 76.

Tubular section 70 has an inner surface 72. Inner surface 72 is generally cylindrical; that is, inner surface 72 is generally circular in cross-section with a generally constant cross-sectional area along the length of inner surface 72 in the direction indicated by arrow 37.

Generally, the cross-sectional area of point 53*b* of attenuating member 10 is approximately equal to the cross-sectional area of inner surface 72. The cross-sectional area of point 54*b* of attenuating member 10 is slightly less than the cross-sectional area of inner surface 72.

An annular cavity or chamber 80 is defined generally between attenuating member 10 and tubular section 70. Annular cavity 80 includes a diverging portion 85 and a converging portion 86. Cavity diverging portion 85 is defined between tubular member converging portion outer surface 42 and tubular section inner surface 72. Annular cavity 80 includes a point 88 of greatest cross-sectional area defined between tubular member outer surface point 49 and tubular section inner surface 72. Cavity converging portion 86 is defined between tubular member diverging portion outer surface 52 and tubular section inner surface 72.

Attenuating member channel 14 is in fluid communication with annular cavity 80 through perforations 59.

An annular gap 95 is defined between the point 54*b* of greatest cross-sectional area of diverging portion outer surface 52 and tubular section 70. Annular cavity 80 and channel portion 71 are in fluid communication through annular gap 95. It is found that greater attenuation is achieved with the above-described configuration of perforations 59 and annular gap 45 than can be achieved with perforations alone. The gap and perforations arrangement forms a resonator which aids attenuation of noise.

An alternative embodiment of constricted attenuating member 3 is a flanged circular attenuating member 110, shown in FIGS. 10–15. Circular attenuating member 110 is substantially similar to circular attenuating member 10, discussed above.

Attenuating member 110 has an inlet end 111 and an outlet end 112, and includes an inner surface 113*a* and an outer surface 113*b*. Inner surface 113*a* defines a channel 114 and has a first end portion 115, a second end portion 116, and a constricted portion 120 therebetween. Constricted portion 120 includes a converging portion 122, a diverging portion 123, and a throat portion 125. Throat portion 125 has a generally circular periphery and includes a point of greatest constriction 126.

Constricted portion 120 includes a converging portion 122 and a diverging portion 123. Converging portion 122 is characterized by a region of rapidly decreasing throat cross-sectional area 127, where the cross-sectional area decreases in the direction from first end portion 115 toward the point of greatest constriction 126. Diverging portion 123 is characterized by a region of gradually increasing cross-sectional area 128, where the cross-sectional area increases in the direction from the point of greatest constriction 126 toward second end portion 116.

First end portion 115 includes a tubular member 130 having an inner surface 131 and an outer surface 132. Inner surface 131 is generally cylindrical; that is, inner surface 131 is generally circular in cross-section with a constant diameter 135 along the length of inner surface 131 in the direction indicated by arrow 137. (Arrow 137 designates the general direction of flow of a fluid through the attenuating member 110, as will be discussed below.) Outer surface 132 is also generally cylindrical and generally parallel to inner surface 131; that is, outer surface 132 is generally circular in cross-section with a constant diameter along the length of outer surface 132 in the direction indicated by arrow 137.

Converging portion 122 includes a tubular member 140 having an inner surface 141 and an outer surface 142. Inner surface 141 is convexly curved; that is, inner surface 141 is generally circular in cross section, with a relatively rapidly decreasing diameter along the length of inner surface 141 in the direction indicated by arrow 137. Outer surface 142 is also generally parallel to inner surface 141; that is, outer surface 142 is generally circular in cross-section with a relatively rapidly decreasing diameter along the length of outer surface 142 in the direction indicated by arrow 137.

Throat portion 125 includes a tubular member 145 having an inner surface 146 and an outer surface 147. Inner surface 146 is generally circular in cross section and includes a region 148 of least cross-sectional area. Similarly, outer surface 147 is generally circular in cross section and includes a region 149 of least cross-sectional area.

Diverging portion 123 similarly includes a tubular member 150 having an inner surface 151 and an outer surface 152. Inner surface 151 is generally conical; that is, inner surface 151 is generally circular in cross-section with an increasing diameter along the length of inner surface 151 in the direction indicated by arrow 137. Outer surface 152 is generally parallel to inner surface 151 and therefore is also generally conical; that is, outer surface 152 is generally circular in cross-section with a linearly increasing diameter along the length of outer surface 152 in the direction indicated by arrow 137.

In the preferred circular attenuating member 110, converging portion 122 includes a point 153 of greatest cross-sectional area. Converging portion inner surface 141 includes a corresponding point 153*a* of greatest cross-sectional area; similarly, converging portion outer surface 142 includes a corresponding point 153*b* of greatest cross-sectional area.

Diverging portion 123 includes a point 154 of greatest cross-sectional area. Diverging portion inner surface 151 includes a corresponding point 154*a* of greatest cross-sectional area; similarly, diverging portion outer surface 152 includes a corresponding point 154*b* of greatest cross-sectional area. Diverging portion 123 diverges at an angle less than that which produces flow separation. Preferably diverging portion 123 diverges at an angle generally between 7° and 14°; that is, an angle 156 of between 3.5° and 7° is defined between diverging portion 123 and longitudinal axis 157.

Attenuating member 110, shown in FIGS. 10–15, differs from the attenuating member 10, shown in FIGS. 2–9, in that attenuating member 110 is not a single integral member. Attenuating member 110 is formed of a first member 160 and a second member 161 generally symmetrical with first member 160. First member 160 and second member 161 have mating edges 161*a* and include flanges 162 and 163, respectively. Flanges 162, 163 include mating surfaces 164 and 165, respectively. Flange mating surfaces 164 engage flange mating surfaces 165 such that, when engaged, first member 160 and second member 161 define channel 114. A typical means for engaging members 160 and 161 is by welding, although other means for engaging are contemplated, such as using screws, clamps or the like.

In typical use, attenuating element 110 is disposed coaxially, or in-line, with a tubular portion of a tail pipe, connecting pipe or muffler.

Although not shown, attenuating member 220 may include diverging portion perforations and a gap generally between diverging portion point 154*a* of greatest cross-sectional area and a tubular housing, substantially similar to the gap and perforations arrangement shown and described for attenuating member 10.

II. SCOOP RESONATOR EMBODIMENT

A third embodiment of constricted attenuating member 3 is a scoop attenuating member 210, shown in FIGS. 16–20. Scoop attenuating member 210 has an inlet end 211 and an outlet end 212, and includes an inner surface 213*a* and an outer surface 213*b*. Inner surface 213*a* defines a channel 214 and has a first end portion 215, a second end portion 216, and a constricted portion 220 therebetween. Constricted portion 220 includes a converging portion 222, diverging portion 223 and a throat portion 225 therebetween. Throat portion 225 includes a point of greatest constriction 226.

Figure 20:
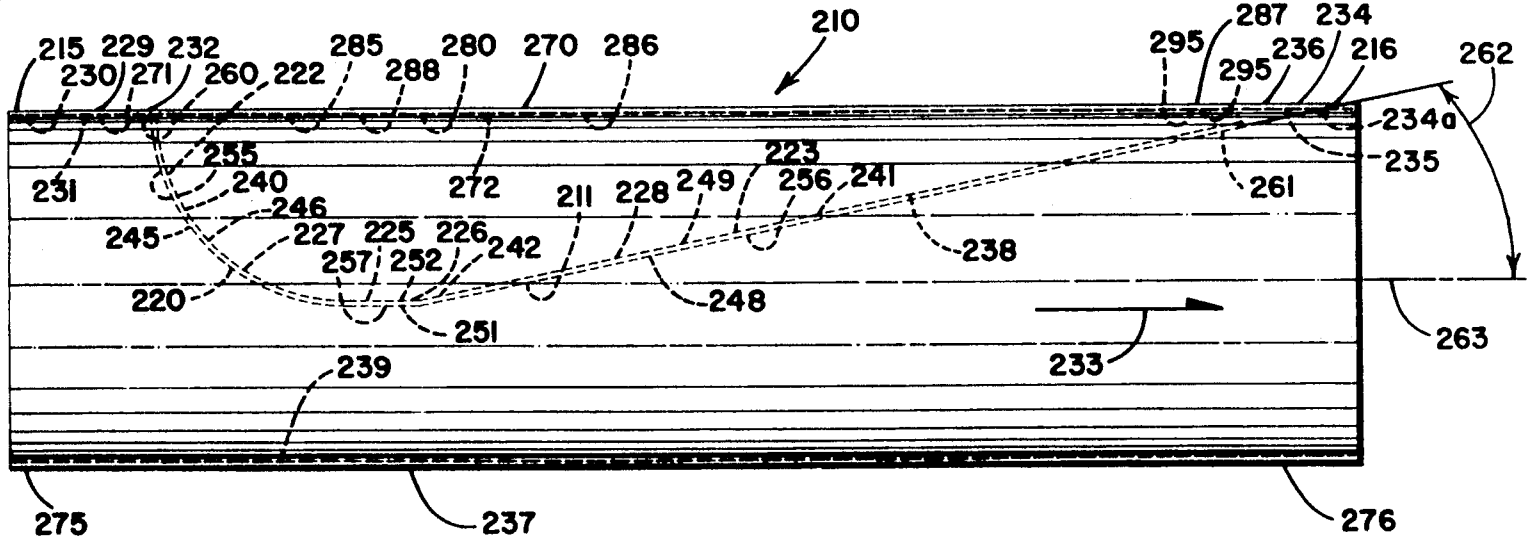
FIG. 20 is a side elevational view of the element in FIG. 16.
Figure 21:
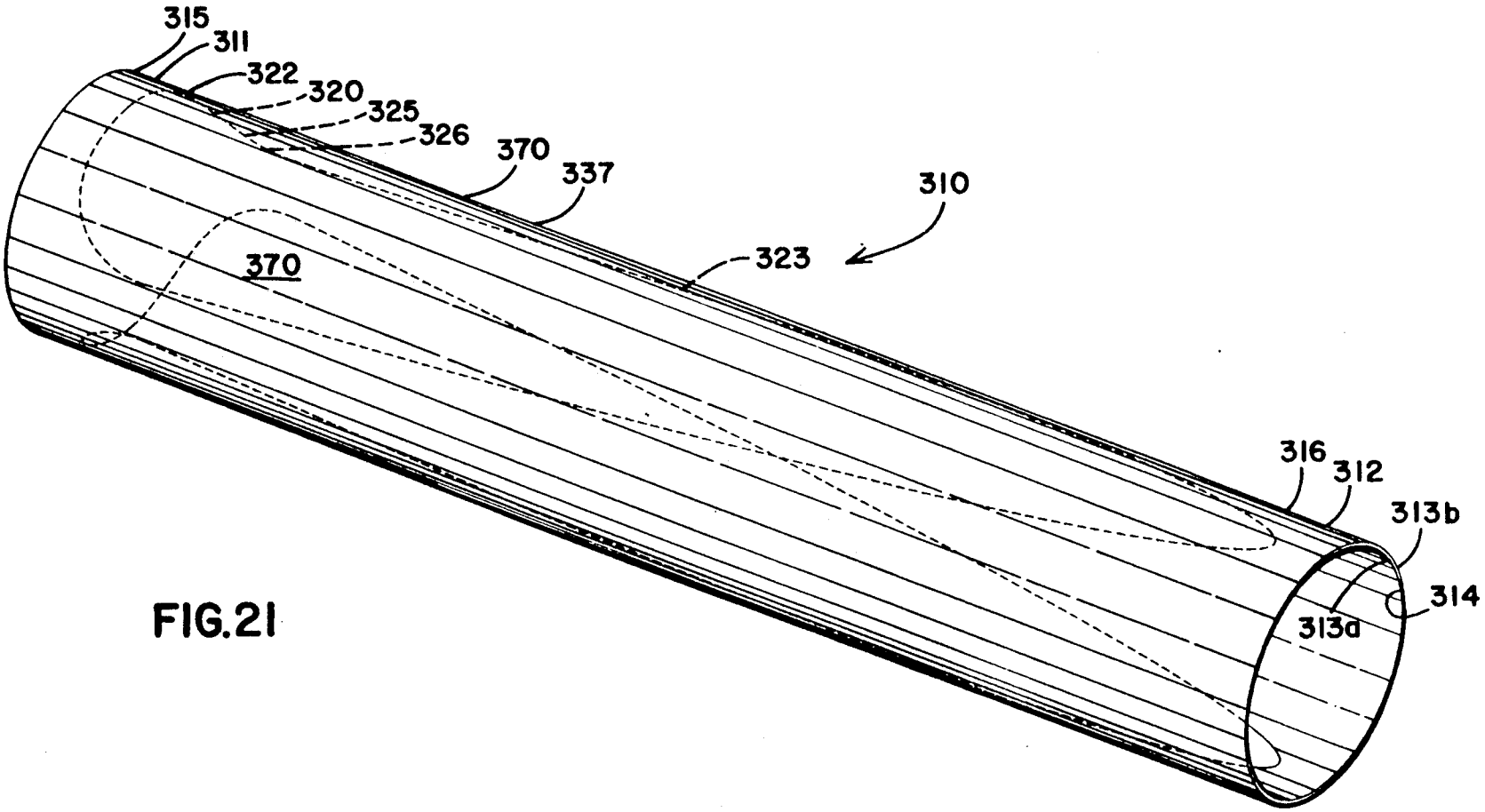
FIG. 21 is a perspective view of an alternate embodiment of an attenuating element.
Figure 23:
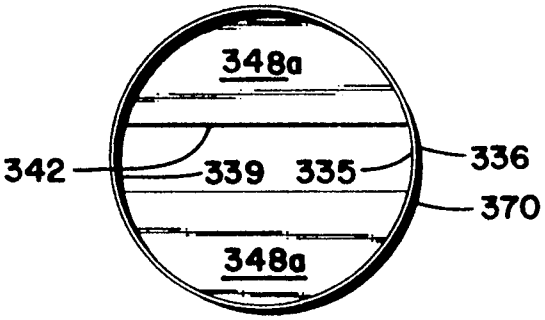
FIG. 23 is an outlet end view as seen from the right of the attenuating of FIG. 21.
Figure 22:
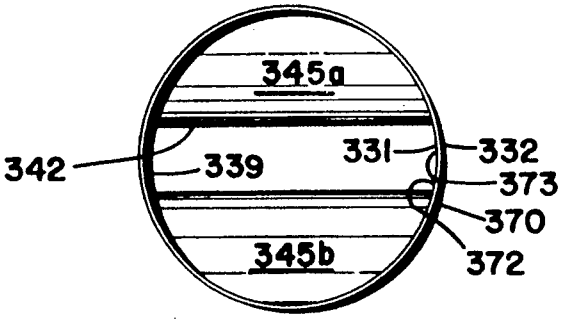
FIG. 22 is an inlet end view as seen from the left end of the attenuating element in FIG. 21.

As shown in FIG. 20, converging portion 222 is characterized by a region of rapidly decreasing throat cross-sectional area 227, where the cross-sectional area decreases in the direction from the first end portion 215 to the throat portion 225. Diverging portion 223 is characterized by a region of gradually increasing cross-sectional area 228, where cross-sectional area increases in the direction from the point of greatest constriction 226 toward the second end portion 216.

First end portion 215 includes a generally cylindrical tubular member 229 defining a channel portion 230. Cylindrical tubular member 229 has an inner surface 231 and an outer surface 232. Inner surface 231 is generally cylindrical; that is, inner surface 231 is generally circular in cross-section with a constant diameter along the length of inner surface 231 in the direction indicated by arrow 233. (Arrow 233 designates the general direction of flow of a fluid through the attenuating member 210, as will be discussed below.)

Second end portion 216 includes a generally cylindrical tubular member 234 defining a channel portion 234*a*. Cylindrical tubular member 234 has an inner surface 235 and an outer surface 236 generally parallel to inner surface 235. Inner surface 235 is generally cylindrical; that is, inner surface 235 is generally circular in cross section with a constant diameter along the length of inner surface 235 in the direction indicated by arrow 233.

Constricted portion 220 includes a generally cylindrical tubular member 237 and a contoured constricting member 238. Tubular member 237 includes an inner surface 239. Constricting member 238 includes a concave curved member 240, and a diverging planar member 241. Concave curved member 240 may be immediately adjacent diverging planar member 241; alternatively, there may be a planar throat member 242 between concave curved member 240 and diverging planar member 241, as shown in FIGS. 16–20.

Concave curved member 240 has an inner surface 245 and an outer surface 246, generally parallel to inner surface 245. Diverging planar member 241 has an inner surface 248 and an outer surface 249, generally parallel to inner surface 248. Planar member 242 includes an inner surface 251 and an outer surface 252, generally parallel to inner surface 251.

A converging channel portion 255 is defined by concave curved member inner surface 245 and tubular member inner surface 239. A diverging channel portion 256 is generally defined by diverging planar member inner surface 248 and tubular member inner surface 239. A channel portion 257 of greatest constriction is defined by planar throat member inner surface 251 and cylindrical tubular member inner surface 239. Converging channel portion 255 has a point 260 of greatest cross-sectional area, substantially equal to the cross-sectional area of channel portion 230. Diverging channel portion 256 includes a point 261 of greatest cross-sectional area having a cross-sectional area slightly less than the cross-sectional area of converging channel portion point 260.

Diverging planar member 251 preferably defines an angle 262 with longitudinal axis 263 of not more than about 14°. Separation of the flow may result in the diverging portion 223 if angle 262 is substantially greater than 14°. Separation of the flow will cause increased back pressure which may be undesirable in a particular exhaust system since increased back pressure may reduce engine efficiency.

Diverging planar member 251 may include a perforated portion 265 having perforations 266. Perforations 366 are preferably generally circular. The total cross-sectional area of these perforations are dependent on the frequency band of noise to be attenuated by the device.

Typically, contoured constricting member 238 is suspended in a tubular housing section 270 such that a portion of tubular housing section 270 forms cylindrical tubular member 237. This arrangement is best shown in FIG. 20.

Tubular section 270 defines a channel portion 271 and may be a portion of a tail pipe, a connecting pipe, or a muffler. The tubular section 270 has an inner surface 272 and includes an inlet portion 275 and an outlet portion 276.

A cavity or chamber 280 is generally defined between the attenuating member 210 and the tubular section 270. Annular cavity 280 includes a diverging cavity portion 285, a converging cavity portion 286 and a point of cavity greatest cross-sectional area 288. Diverging cavity portion 285 is generally defined between tubular section inner surface 272 and concave curved member outer surface 246. Converging cavity portion 286 is generally defined between tubular section inner surface 272 and diverging planar member outer surface 249. Converging cavity portion 286 includes a point of least cross-sectional area 287. Point of cavity greatest cross-sectional area 288 is defined between tubular member inner surface 239 and planar throat member outer surface 252.

Attenuating member channel 214 is in fluid communication with cavity 280 through perforations 266.

A gap 295 is defined between tubular section inner surface 272 and diverging planar member outer surface 249 at converging cavity portion point of least cross-sectional area 287. Cavity 280 and channel portion 271 are in fluid communication through gap 295. It is found that greater attenuation is achieved with the above-described configuration of perforations 266 and gap 295 than can be achieved with perforations alone. The gap and perforations arrangement forms a resonator which aids attenuation of noise.

A fourth embodiment of a constituted attenuating member 3 is a double-scoop constricted attenuating member 310, as shown in FIGS. 21–24. Attenuating member 310 has an inlet end 311 and an outlet end 312, and includes an inner surface 313*a* and an outer surface 313*b*. Inner surface 313*a* defines a channel 314 and has a first end portion 315, a second end portion 316, and a constricted portion 320 therebetween. Constricted portion 320 includes a converging portion 322, a diverging portion 323, and a throat portion 325 therebetween. Throat portion 325 includes a point of greatest constriction 326.

Figure 24:
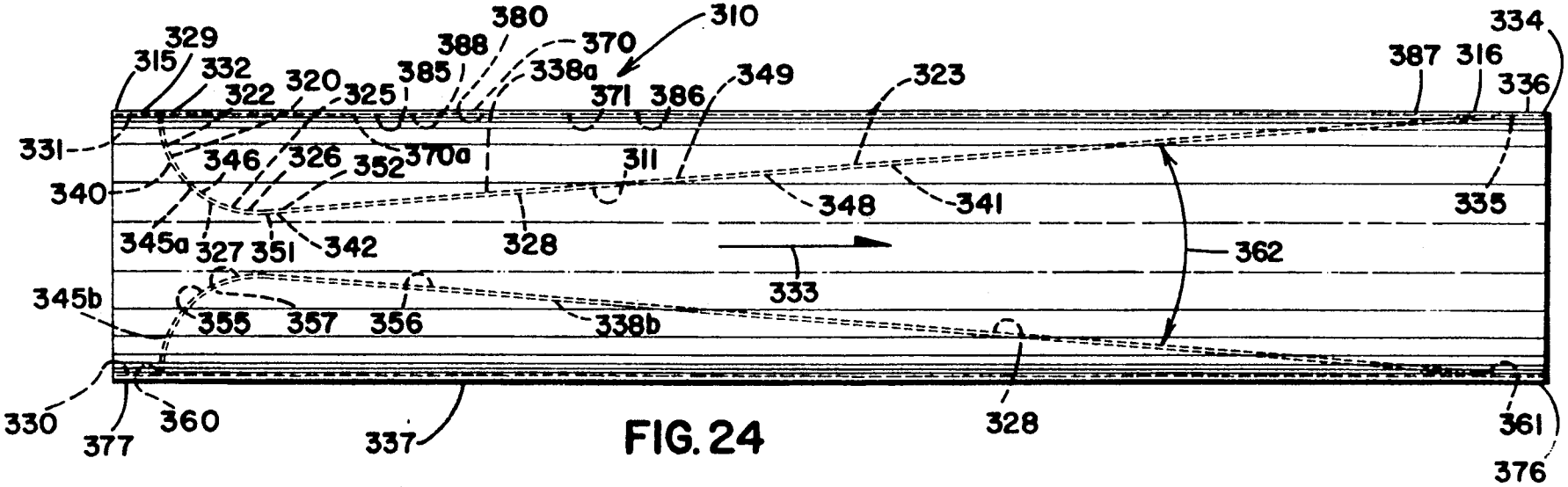
FIG. 24 is a side elevational view of the element in FIG. 21.
Figure 29:
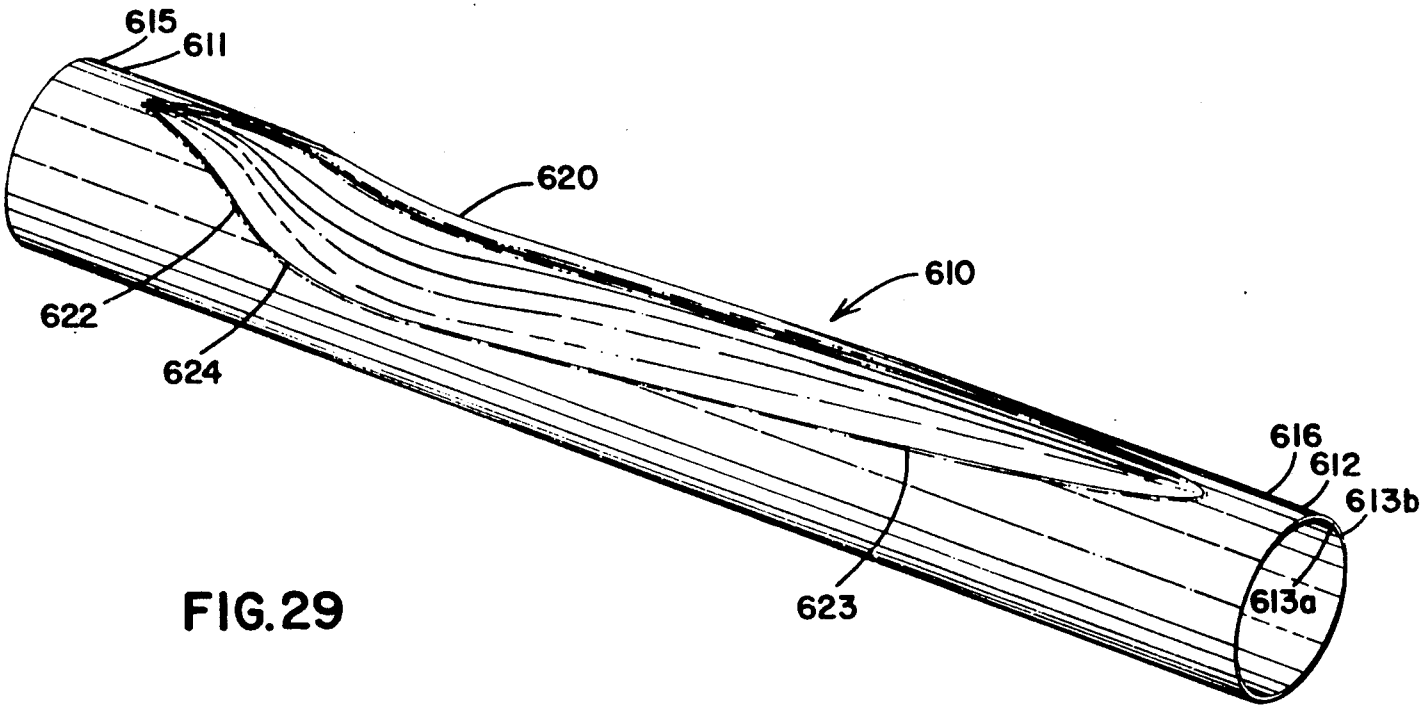
FIG. 29 is a perspective view of an alternate embodiment of an attenuating element.
Figure 30:
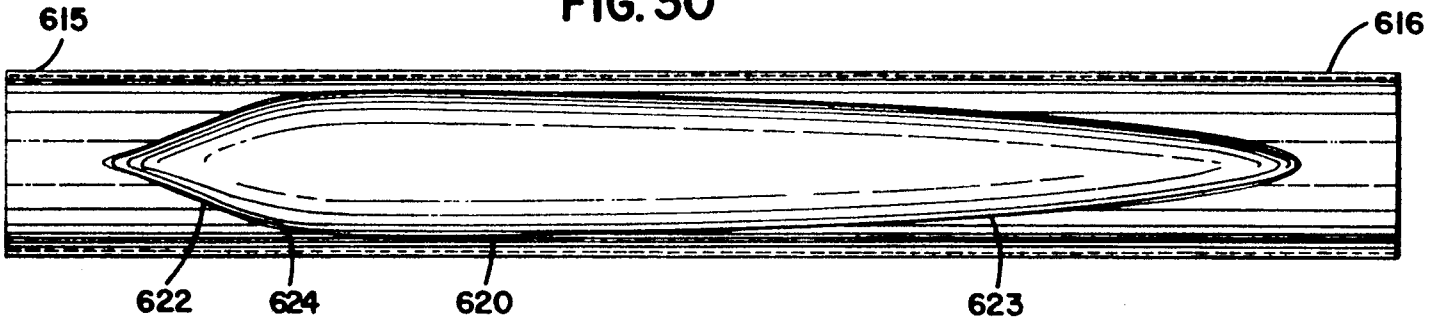
FIG. 30 is an elevational view of the attenuating element in FIG. 29.

As seen in FIG. 24, the converging portion 322 is characterized by a region of rapidly decreasing throat cross-sectional area 327, where the cross-sectional area decreases in the direction from the first end portion 315 to the point of greatest constriction 326. The diverging portion 323 is characterized by a region of gradually increasing cross-sectional area 328 where the cross-sectional area increases in the direction from the point of greatest constriction 326 toward the second end portion 316.

First end portion 315 includes a generally cylindrical member 329 defining a channel portion 330. Cylindrical member 329 has an inner surface 331 and an outer surface 332. Inner surface 331 is generally cylindrical; that is, inner surface 331 is generally circular in cross-section with the constant diameter along the length of inner surface 331 in the direction indicated by arrow 333.

Second end portion 316 includes a cylindrical member 334. Cylindrical tubular member 334 has an inner surface 335 and an outer surface 336. Inner surface 335 is generally cylindrical; that is, inner surface 335 is generally circular in cross-section with the constant diameter along the length of inner surface 335 in the direction indicated by arrow 333.

Constricted portion 320 includes a generally cylindrical tubular member 337 and two contoured constricting members 338*a,b*. Description follows of contoured constricting member 338*a*. It is to be understood that contoured constricting member 338*b* is substantially similar to member 338*a*.

Constricting member 338*a* includes a concave curved member 340, diverging planar member 341, and a planar throat member 342 therebetween. Concave curved member 340 has an inner surface 345 and an outer surface 346, generally parallel to inner surface 345. Diverging planar member 341 has an inner surface 348 and an outer surface 349, generally parallel to inner surface 348. Planar member 342 includes an inner surface 351 and an outer surface 352, generally parallel to inner surface 351.

A converging channel portion 355 is defined by concave curved member inner surfaces 345*a,b* and tubular member inner surface 339. A diverging channel portion 356 is generally defined by diverging planar member inner surfaces 348*a,b* and tubular member inner surface 339. A channel portion 357 of greatest constriction is defined by planar throat member inner surface 351 and cylindrical tubular member inner surface 339. Converging channel portion 355 has a point 360 of greatest cross-sectional area, substantially equal to the cross-sectional area of channel portion 330. Diverging channel portion 356 includes a point 361 of greatest cross-sectional area.

Diverging planar members 341*a,b* preferably define an angle 362, therebetween, of 4–8°. The optimal angle 362 is dependant upon the back pressure acceptable for the engine with which attenuating element 310 is used. The greater the angle 362 is, the greater likelihood that the flow through channel portion 356 will separate. This separation of flow may cause increased back pressure which may reduce engine efficiency and may also increase noise. As noted above, increased back pressure may reduce engine efficiency.

Typically, contoured constricting members 338*a* and 338*b* are suspended in a tubular housing section 370 having an inner surface 370*a*, such that a portion of tubular housing section 370 forms cylindrical tubular member 337. This arrangement is best shown in FIG. 24.

Tubular section 370 defines a channel portion 371 and may be a portion of a tail pipe, an exhaust pipe, or a muffler. The tubular section 370 includes an inlet portion 375 and an outlet portion 376.

A cavity or chamber 380 is generally defined between the attenuating member 310 and the tubular section 370. Cavity recess 380 includes a diverging cavity portion 385, a converging cavity portion 386 and a point of cavity greatest cross-sectional area 388 therebetween. Diverging cavity portion 385 is generally defined between tubular section inner surface 370*a* and concave curved member outer surface 346. Converging cavity portion 386 is generally defined between tubular section inner surface 370*a* and diverging planar member outer surface 349. Converging cavity portion 386 includes a point of least cross-sectional area 387. Point of cavity greatest cross-sectional area 388 is defined between tubular section inner surface 370*a* and planar throat member outer surface 352.

As shown in FIG. 24A, converging cavity portion point of least cross-sectional area 387 may have a cross-sectional area less than the cross-sectional area of tubular section inner surface 370*a*, such that a gap 395 is formed between diverging planar member 341 and tubular section inner surface 370*a*. The gap allows cavity 380 to be in fluid communication with diverging channel portion 356. Further, diverging planar members may include perforated portions 396 perforations 397 allowing diverging channel portion 356 to be in fluid communication with cavity 380. This gap and perforation arrangement forms a resonator which aids attenuation of noise.

III. MULTI-CHANNEL ELEMENT EMBODIMENT

A fifth embodiment of constricted attenuating member 3 is a multi-channel constricted attenuating member 410, shown in FIGS. 25–28.

Attenuating member 410 has an inlet end 410*a* and an outlet end 410*b*, and includes an outer surface 410*c*. Further, attenuating member 410 includes a plurality of tubes 411(*a–g*) each having an inner surface 412 defining a channel 413. The structure of only one tube 411*a* will be here described, but it is to be understood that tubes 411*b–g* are substantially similar. Tube 411*a* has a first end portion 415, second end portion 416, and a constricted portion 420. Constricted portion 420 includes a converging portion 422, a diverging portion 423, and a throat portion 425 therebetween. Throat portion 425 includes a point of greatest constriction 426.

Converging portion 422 is characterized by a region of rapidly decreasing throat cross-sectional area 427, where the cross-sectional area decreases in the direction from the first end portion 415 to the point of greatest constriction 426. The diverging portion 423 is characterized by a region of gradually increasing cross-sectional area 428, where the cross-sectional area increases in the direction from the point of greatest constriction 426 toward the second end portion 416.

Converging portion 422 has an inner surface 431. Inner surface 431 is convexly curved; that is, inner surface 431 is generally circular in cross section, with a parabolically decreasing diameter along the length of inner surface 431 in the direction indicated by arrow 433. (Arrow 433 designates the general direction of flow of a fluid through the attenuating member 410, as will be described below.)

Throat portion 425 includes an inner surface 436. Inner surface 436 is generally circular in cross section and includes a region 438 of least cross-sectional area.

Diverging portion 423 similarly includes an inner surface 441. Inner surface 441 is generally conical; that is, inner surface 441 is generally circular in cross-section with an increasing diameter along the length of inner surface 441 in the direction indicated by arrow 433.

In the preferred circular attenuating member 410, converging portion inner surface 431 has a point 443 of greatest cross-sectional area with a cross-sectional area which is (1:1 ratio) of the cross-sectional area of the region 438 of throat portion inner surface 436. Diverging portion inner surface 441 has a point 444 of greatest cross-sectional area with a cross-sectional area which is substantially equal to point 443 of greatest cross-sectional area of converging portion inner surface 431.

Diverging portion 423 diverges at an angle less than that which produces flow separation. Preferably diverging portion 423 diverges at an angle generally between about 7° and 14°; that is, an angle 466 of between about 3.5° and 7° is defined between diverging portion 123 and longitudinal axis 467.

In typical use, attenuating member 410 is fixed in the tubular housing section 470 having an inner surface 472 defining a channel 473. Housing section 470 includes an inlet portion 475, and an outlet portion 476. Housing section 470 is generally cylindrical; that is, inner surface 472 is generally circular in cross-section with a generally constant diameter along the length of inner surface 472 in the direction indicated by arrow 433.

Attenuating member 410 may be manufactured in at least two ways. FIG. 25 shows an attenuating member 410 according to a first method of manufacturing, wherein channels 412(*a–g*) are formed from a single member 477. The channels may, for instance, be bored, machined, cast or molded from single member 477.

IV. DEFORMED ELEMENT EMBODIMENT

A further embodiment of a constricted attenuating element 3 is a deformed constricting member 610, shown in FIGS. 29–32. Constricting member 610 preferably is integral with a tail pipe, connecting pipe or muffler. Attenuating member 610 has an inlet end 611 and an outlet end 612, and includes an inner surface 613*a* and an outer surface 613*b*. Inner surface 613*a* defines a channel 614 and has a first end portion 615, a second end portion 616, and a constricted portion 620 therebetween. Constricted portion 620 includes a converging portion 622, a diverging portion 623 and a throat portion 624 therebetween. Throat portion 624 includes a point of greatest constriction 625.

Figure 31:
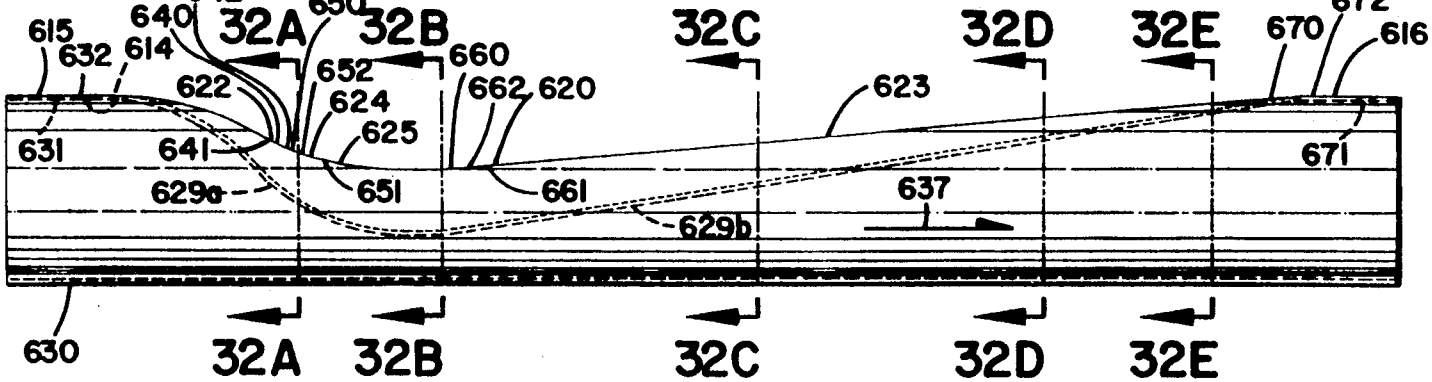
FIG. 31 is a side elevational view of the element in FIG. 29.

The shape of the periphery of member 610 is generally represented by peripheral patterns 626*a–e* shown in FIGS. 32*a–e*, respectively, corresponding to cross-sections A–E, respectively, indicated in FIG. 31. Patterns 626*a–e* are generally crescent-shaped and include a bottom portion 627*a–e* and a top portion *a–e*. "Top" and "bottom" are used throughout for convenience in referring to the drawings; the terms should not be considered limiting. A greater cross-sectional area is defined by peripheral pattern 626*a* than is defined by peripheral pattern 626*b*. Further, a greater cross-sectional area is defined by peripheral pattern 626*e* than is defined by peripheral pattern 626*b*. Patterns 626*a–e* have substantially similar circumferences.

The converging portion 622 is characterized by a region of rapidly decreasing throat cross-sectional area 629*a*, where the cross-sectional area decreases in the direction from the first end portion 615 to the throat portion 625.

The diverging portion 623 is characterized by a region of gradually increasing cross-sectional area 629*b*, where cross-sectional area increases in the direction from the point of greatest constriction 626 toward the second end portion 616.

First end portion 615 includes a tubular member 630 having an inner surface 631 and an outer surface 632. Inner surface 631 is generally cylindrical; that is, inner surface 631 is generally circular in cross-section with the constant diameter along the length of inner surface 631 in the direction indicated by arrow 637. (Arrow 637 designates the general direction of flow of a fluid through the attenuating member 610, as will be discussed below.) Outer surface 632 is generally parallel to inner surface 631 and therefore generally cylindrical; that is, outer surface 632 is generally circular in cross-section with the constant diameter along the length of outer surface 632 in the direction indicated by arrow 637.

Figures 32A, 32B, 32C, 32D, 32E:
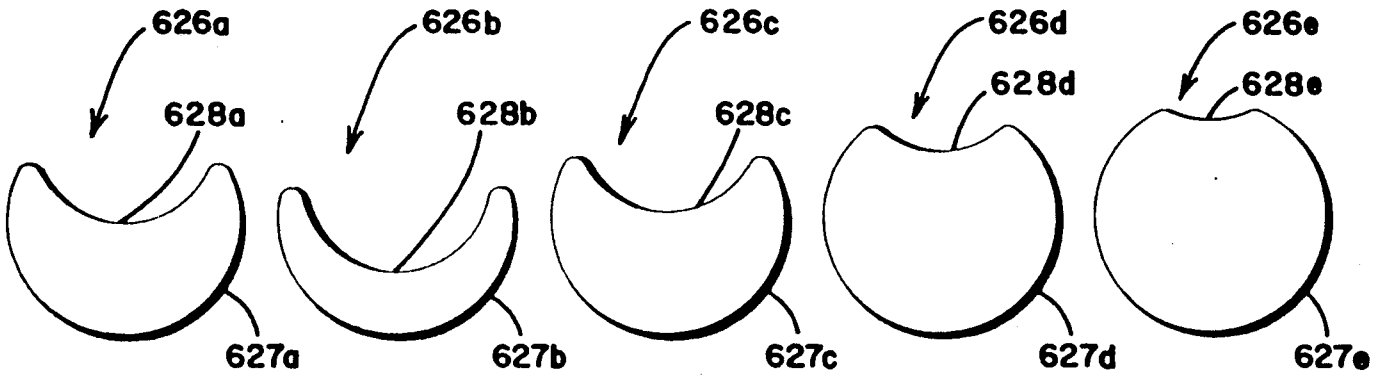
FIGS. 32*a–e* are patterns representing the shape of the attenuating element shown in FIGS. 29–31, taken along lines 32*a–e*, respectively, in FIG. 31.
Figure 33:
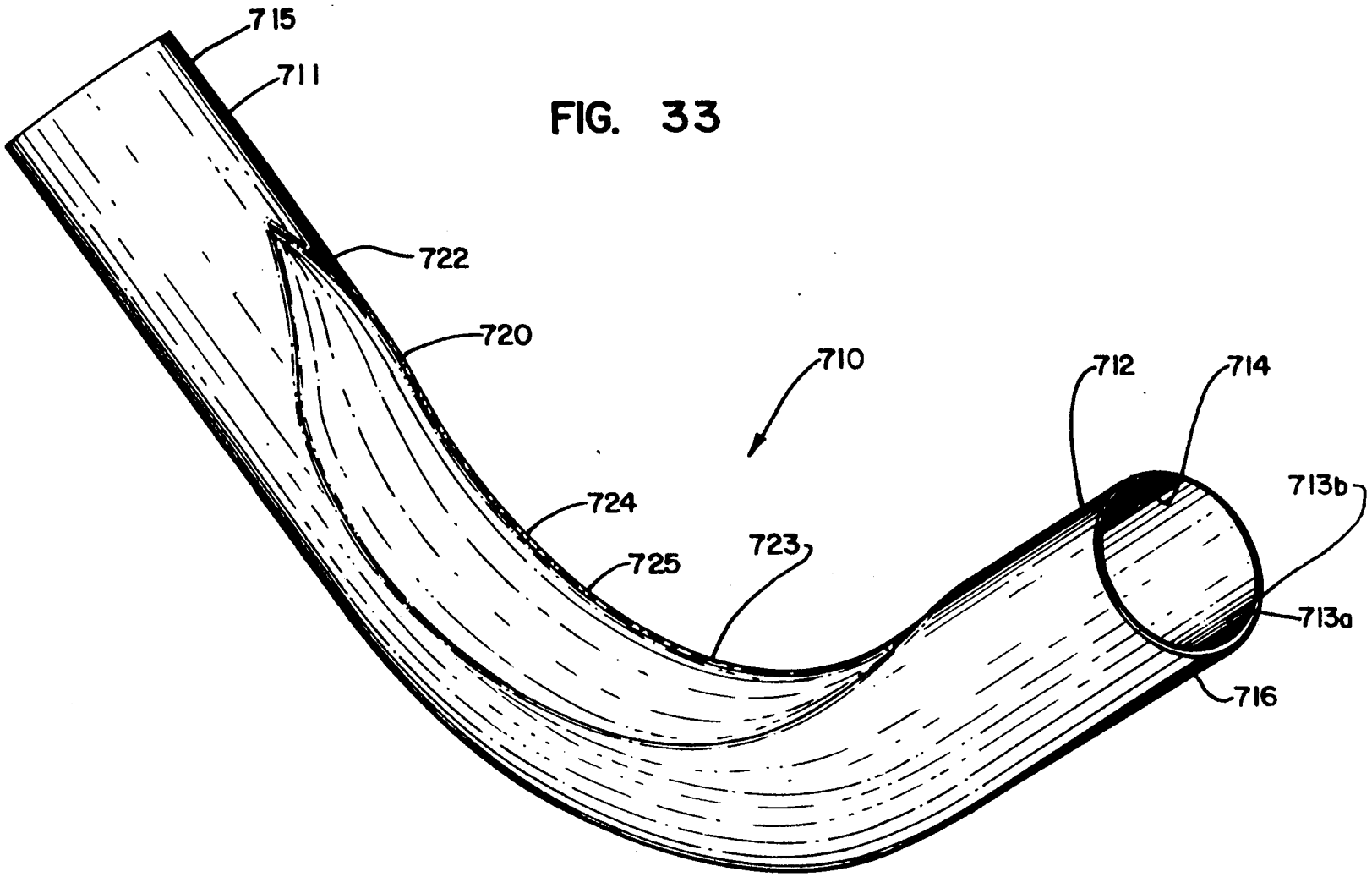
FIG. 33 is a perspective view of an alternate embodiment of attenuating elements.
Figure 36:
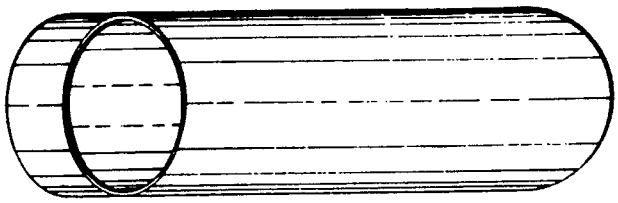
FIG. 36 is a side elevational view as seen from the right side of the element shown in FIG. 34.
Figure 34:
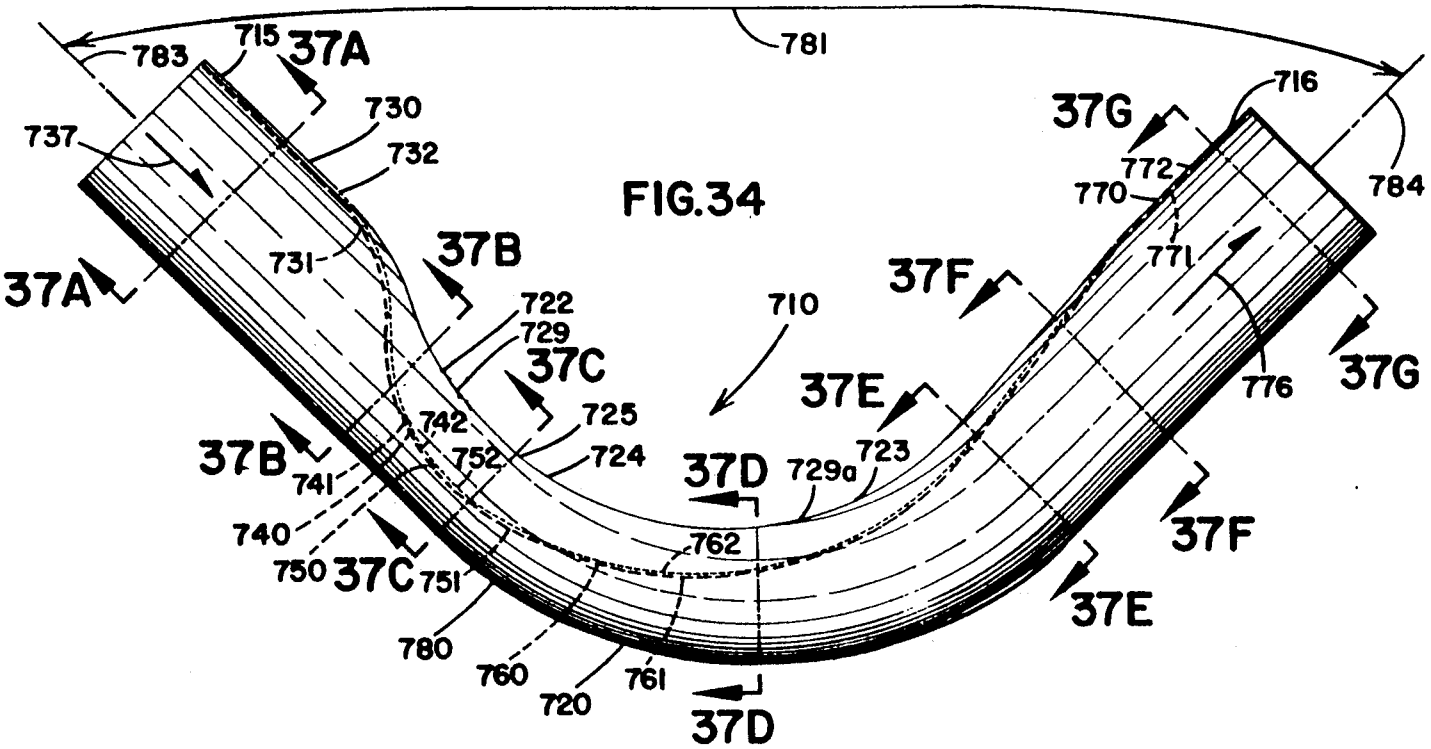
FIG. 34 is a side elevational view of the element in FIG. 33.
Figure 35:
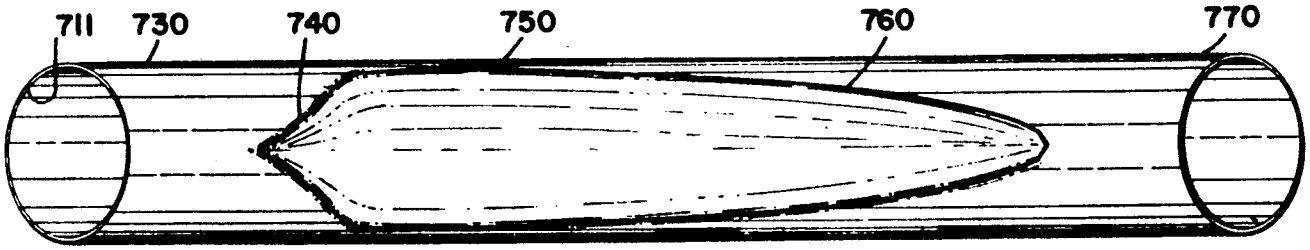
FIG. 35 is an elevational view of the embodiment of the attenuating element shown in FIG. 33.

Converging portion 622 includes a tubular member 640 having an inner surface 641 and an outer surface 642 generally parallel to inner surface 641. Pattern 626*a*, FIG. 32*a*, represents the shape of inner surface 641 at cross-section A.

Throat portion 624 includes a tubular member 650 having an inner surface 651 and an outer surface 652 generally parallel to inner surface 651. Inner surface 651 is generally crescent-shaped in cross-section. Pattern 626*b*, FIG. 32*b*, represents the shape of inner surface 651 at the point of maximum constriction 625.

Diverging portion 623 similarly includes a tubular member 660 having an inner surface 661 and an outer surface 662 generally parallel to inner surface 661. Patterns 626*c–e*, FIGS. 32*c–e*, represent the shapes of the inner surface 661 at cross-sections C–E, respectively.

Second end portion 616 includes a tubular member 670 having an inner surface 671 and an outer surface 672 generally parallel to inner surface 671. Inner surface 671 is generally cylindrical; that is, inner surface 671 is generally circular in cross-section with a constant diameter along the length of inner surface 671 in the direction indicated by arrow 637.

V. ELBOW ELEMENT EMBODIMENT

A further embodiment of a constricted attenuating element 3 is an elbow constricted attenuating member 710 as shown in FIGS. 33–37. Elbow attenuating member 710 preferably is integral with a tail pipe, connecting pipe, or muffler. Attenuating member 710 has an inlet end 711 and an outlet end 712, and includes an inner surface 713*a* and an outer surface 713*b*. Inner surface 713*a* defines a channel 714 and has a first end portion 715, a second end portion 716 and a constricted portion 720 therebetween.

Constricted portion 720 includes a converging portion 722, a diverging portion 723, and a throat portion 724 therebetween. Throat portion 724 includes a point of greatest constriction 725. Member 710 has a substantially constant circumference along its length. The shape of the periphery of member 710 is generally represented by peripheral patterns 726*a–g* shown in FIGS. 37*a–g*, respectively, corresponding to cross-sections A–G, respectively, indicated in FIG. 34. Patterns 726*b–f* are generally crescent-shaped and include a bottom portion 727*b–f* and a top portion 728*b–f*. A greater cross-sectional area is defined by peripheral pattern 726*c* than is defined by peripheral pattern 726*g*. Further, a greater cross-sectional area is defined by peripheral pattern 726*g* than is defined by peripheral pattern 726*c*.

The converging portion 722 is characterized by a region of rapidly decreasing throat cross-sectional area 729, where the cross-sectional area decreases in the direction from the first end portion 715 to the throat portion 724. The diverging portion 723 is characterized by a region of gradually increasing cross-sectional area 729*a*, where cross-sectional area increases in the direction from the point of greatest constriction 726 toward the second end portion 716.

Figures 37A, 37B, 37C, 37D, 37E, 37F, 37G:
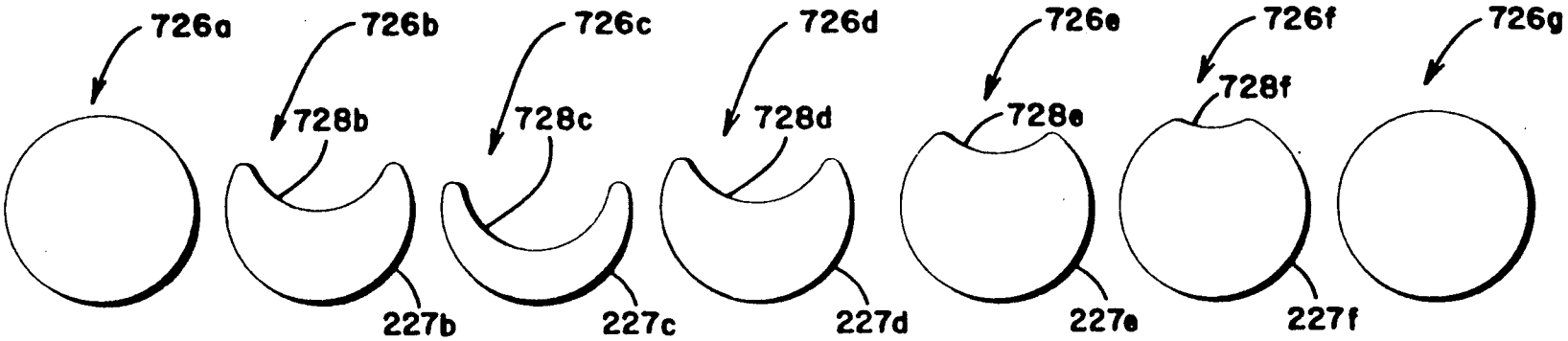
FIGS. 37*a–g* are shape patterns taken along lines A–G, respectively, in FIG. 34.
Figure 38:
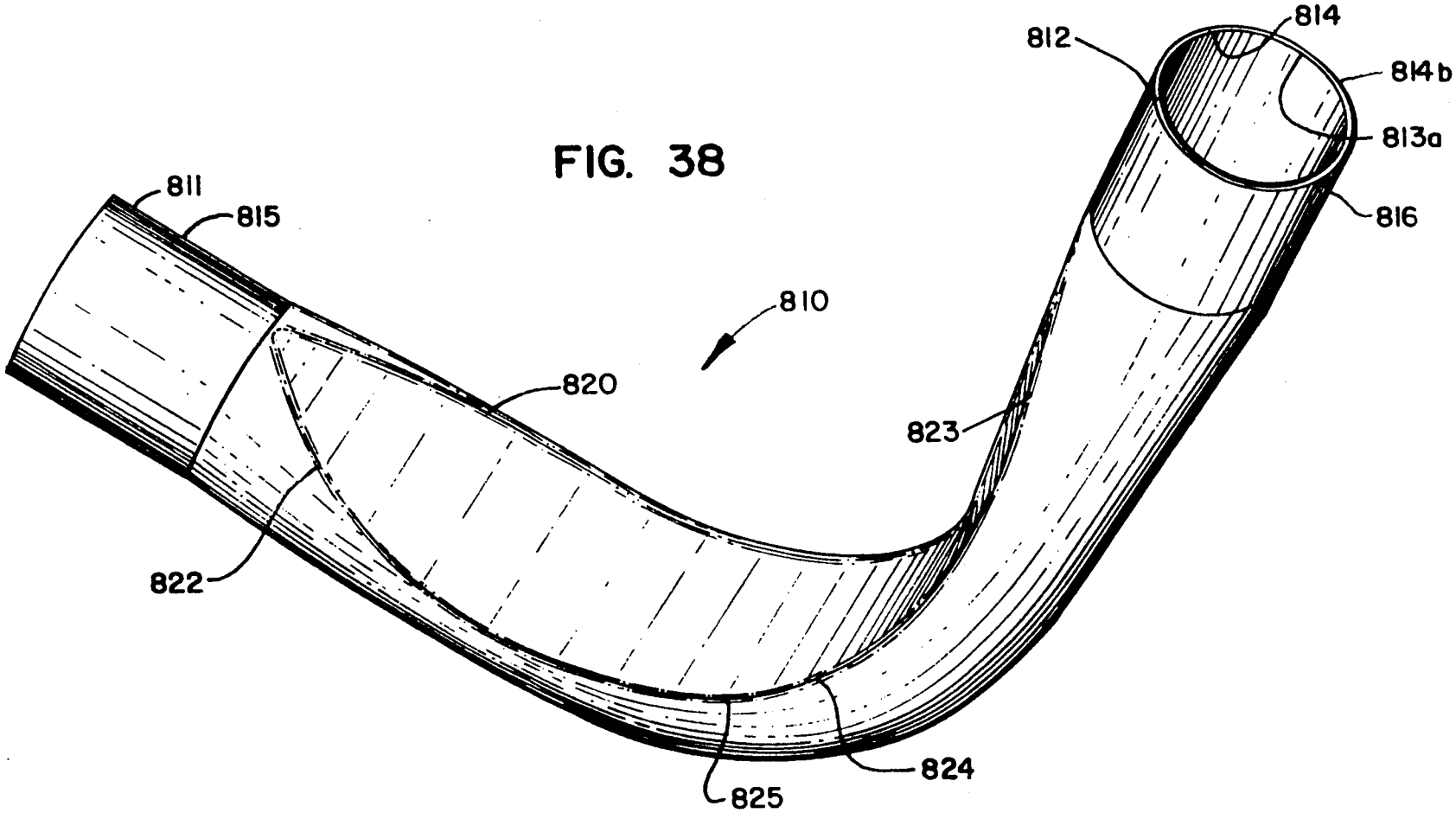
FIG. 38 is a perspective view of an alternate embodiment of an attenuating element.
Figure 39:
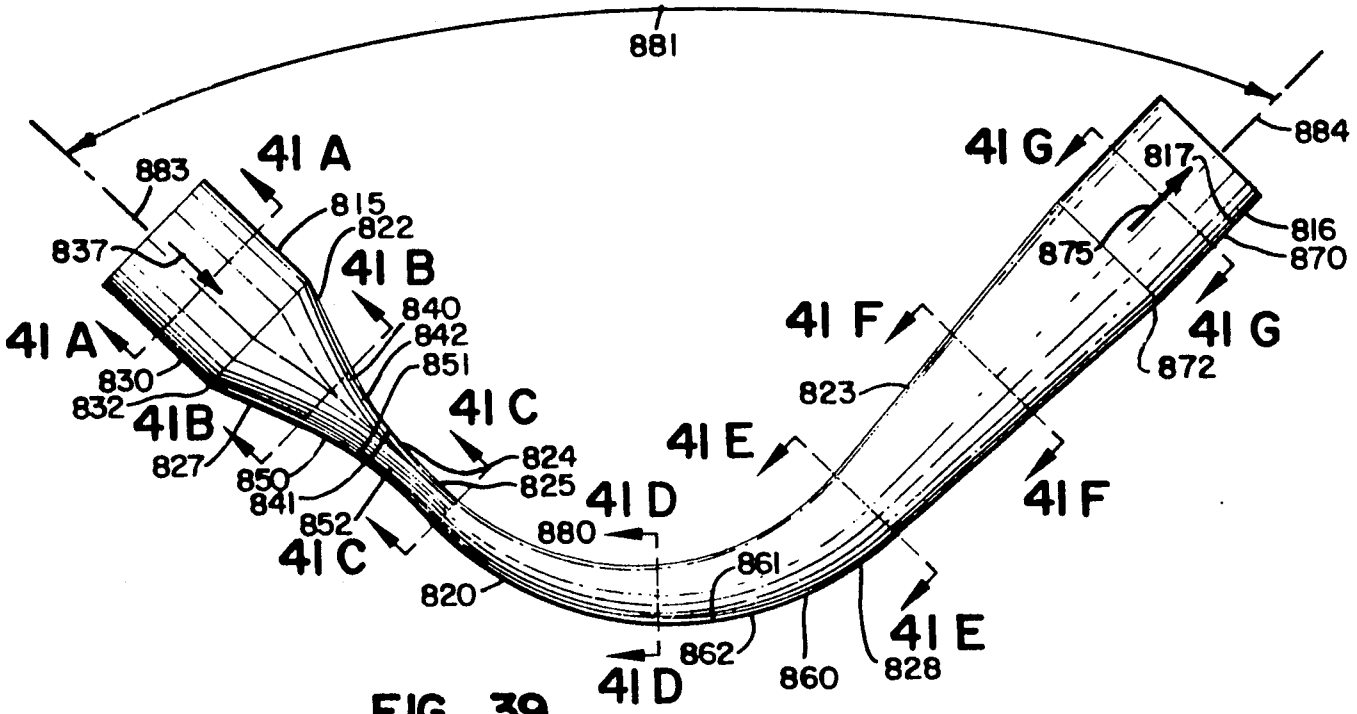
FIG. 39 is a side elevational view of the element in FIG. 38.
Figure 40:
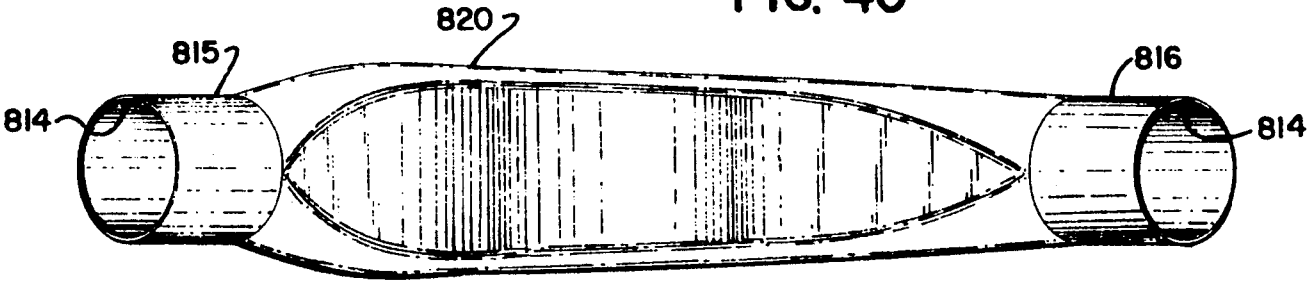
FIG. 40 is a top elevational view of the embodiment of an attenuating element shown in FIG. 38.
Figures 41A, 41B, 41C, 41D, 41E, 41F, 41G:
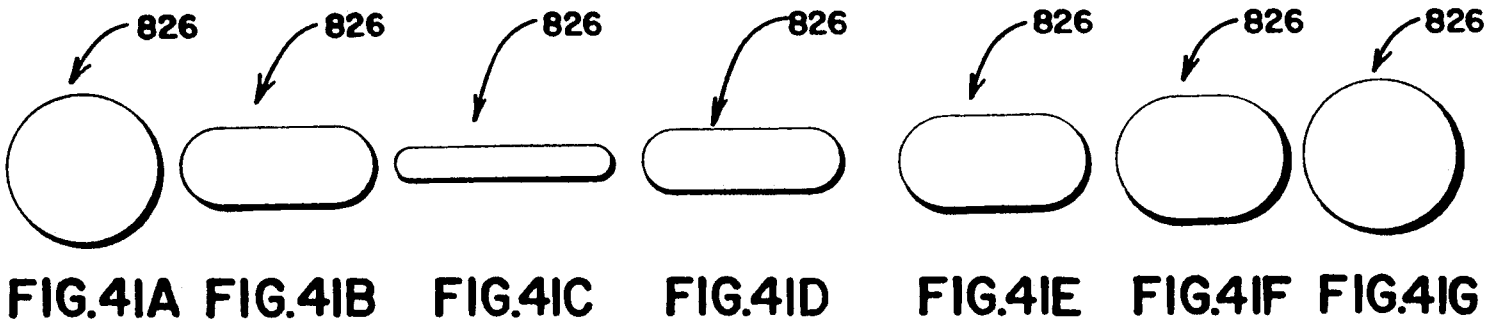
FIGS. 41*a–g* are shape patterns taken along lines A–G of FIG. 39.
Figure 42:
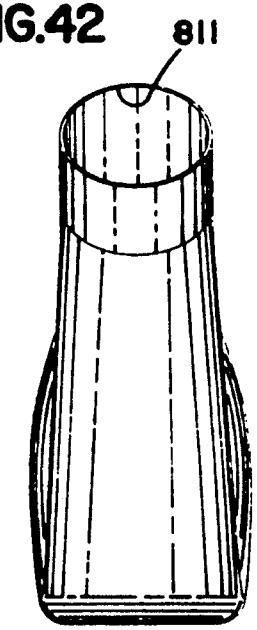
FIG. 42 is a side elevational view as seen from the right side of the element in FIG. 39.
Figure 43:
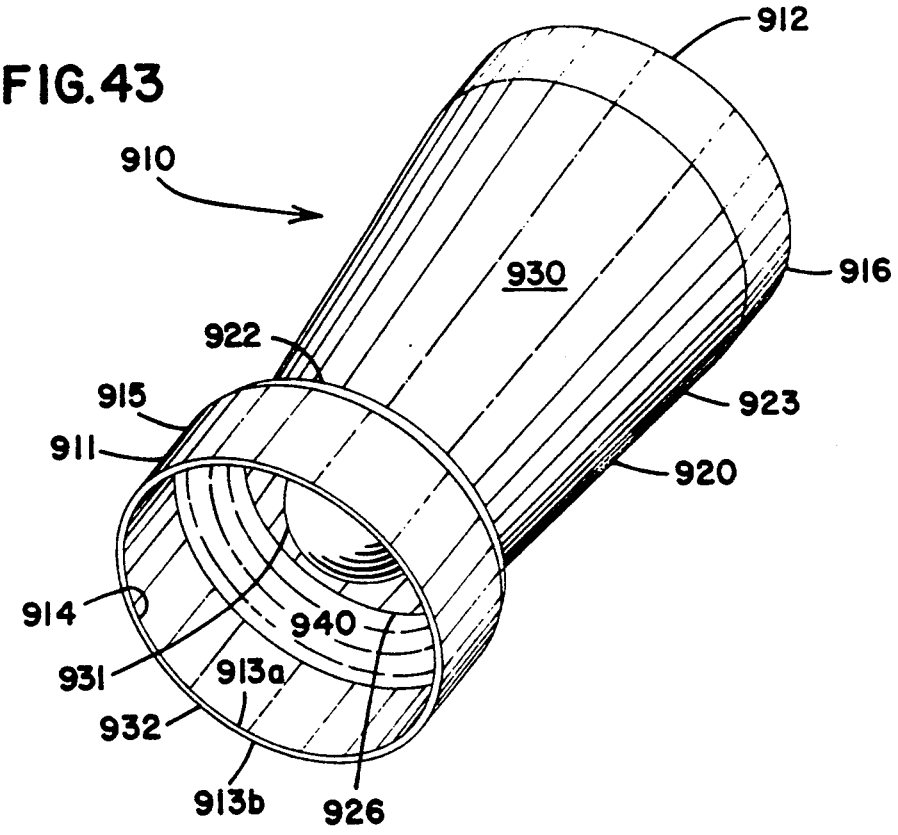
FIG. 43 is a perspective view of an alternate embodiment of an attenuating element.

First end portion 715 includes a tubular member 730 having an inner surface 731 and an outer surface 732 generally parallel to inner surface 731. Inner surface 731 is generally cylindrical; that is, inner surface 731 is generally circular in cross-section with a constant diameter along the length of inner surface 731 in the direction indicated by arrow 737. (Arrow 737 designates the general direction of flow of a fluid through the attenuating member 710, as will be discussed below.) Pattern 726*a*, FIG. 37*a*, represents the shape of inner surface 731 at cross-section A shown in FIG. 34.

Converging portion 722 includes a tubular member 740 having an inner surface 741 and an outer surface 742 generally parallel to inner surface 741. Pattern 726*b*, FIG. 37*b*, represents the shape of inner surface 741 at cross-section B shown in FIG. 34. Throat portion 724 includes a tubular member 750 having an inner surface 751 and an outer surface 752 generally parallel to inner surface 751. Pattern 726*c*, FIG. 37*c*, represents the shape of inner surface 751 a cross-section C shown in FIG. 34.

Diverging portion 723 similarly includes a tubular member 760 having an inner surface 761 and an outer surface 762 generally parallel to inner surface 761.

Second end portion 716 includes a tubular member 770 having an inner surface 771 and an outer surface 772 generally parallel to inner surface 771. Surface 771 is generally cylindrical; that is, inner surface 771 is generally circular in cross-section with a constant diameter along the length of inner surface 771 in the direction indicated by arrow 776. Pattern 726*g*, FIG. 37*g*, represents the shape of inner surface 771 at cross-section G shown in FIG. 34.

Constricted portion 720 further includes an angular bend 780. The angular bend 780 as shown in FIGS. 33–37 is included in the converging portion 722; it is, however to be understood that the angular bend 780 may be included in the throat portion 724 or the diverging portion 723. Angular bend 780 defines an angle 781 between longitudinal axes 783 and 784, where longitudinal axis 783 is generally parallel to fluid flow through first end portion 715, and longitudinal axis 784 is generally parallel to fluid flow through second end portion 716. Angle 781 may be whatever is required by the structural design of the exhaust system.

A further embodiment of a constricted attenuating element 3 is an elbow constricted attenuating member 810, shown in FIGS. 38–42. Attenuating member 810 has an inlet end 811 and an outlet end 812, and includes an inner surface 813*a* and an outer surface 813*b*. Inner surface 813*a* defines a channel 814 and has a first end portion 815, a second end portion 816, and a constricted portion 820 therebetween.

Constricted portion 820 includes a converging portion 822, a diverging portion 823, and a throat portion 824 therebetween. Throat portion 824 includes a point of greatest constriction 825. Attenuating member 810 has cross-sectional patterns 826*a–g* as shown in FIGS. 41*a–g*, taken at cross-sections A–G in FIG. 39. Pattern 826*a* of first end portion is generally circular. Patterns 826*b–f* of the constricted portion 820 are generally oblong but vary in shape along the length of the attenuating member 810. Near first end portion 815, constricted portion pattern 826*b* is nearly circular. The cross-sectional pattern 826*b*, generally near the point of greatest constriction 825, is substantially oblong. A cross-sectional pattern 826*f* near second end portion 816 is nearly circular. The circumference of constricted portion 820 remains constant throughout.

Converging portion 822 is characterized by a region of rapidly decreasing throat cross-sectional area 827, where the cross-sectional area decreases in the direction from the first end portion 815 to the throat portion 825. The diverging portion 823 is characterized by a region of gradually increasing cross-sectional area 828, where cross-sectional area increases in the direction from the point of greatest constriction 826 toward the second end portion 816.

First end portion 815 includes a tubular member 830 having an inner surface 831 and an outer surface 832 generally parallel to inner surface 831. Inner surface 831 is generally cylindrical; that is, inner surface 831 is generally circular in cross-section with the constant diameter along the length of inner surface 831 in the direction indicated by arrow 837. (Arrow 837 designates the general direction of flow of a fluid through the attenuating member 810, as will be discussed below.)

Converging portion 822 includes a tubular member 840 having an inner surface 841 and an outer surface 842 generally parallel to inner surface 841. The shape of inner surface 841 is represented by pattern 826*b*, shown in FIG. 41*b*, described above.

Throat portion 824 includes a tubular member 850 having an inner surface 851 and an outer surface 852 generally parallel to inner surface 851. The shape of throat portion inner surface 851 is represented by pattern 826*c*, shown in FIG. 41*c*, described above.

Diverging portion 823 similarly includes a tubular member 860 having an inner surface 861 and an outer surface 862 generally parallel to inner surface 861. The shape of diverging portion inner surface 861 is represented by patterns 826*d–f*, shown in FIG. 41*d–f*, described above.

Second end portion 816 includes a tubular member 870 having an inner surface 871 and an outer surface 872 generally parallel to inner surface 871. Inner surface 871 is generally cylindrical; that is, inner surface 871 is generally circular in cross-section with the constant diameter along the length of inner surface 871 in the direction indicated by arrow 875. (Arrow 875 designates the general direction of flow of a fluid through the attenuating member 810, as will be discussed below.)

Constricted portion 820 further includes an angular bend 880. The angular bend 880 as shown in FIGS. 38–42 is included in the converging portion 822; it is, however to be understood that the angular bend 880 may be included in the throat portion 824 or the diverging portion 823. Angular bend 880 defines an angle 881 between longitudinal axes 883 and 884, where longitudinal axis 883 is generally parallel to fluid flow through first end portion 815, and longitudinal axis 884 is generally parallel to fluid flow through second end portion 816.

VI. CONSTRICTING MEMBER EMBODIMENT

An alternate embodiment of a constricted attenuating element 3 is an annular constricted attenuating member 910, shown in FIGS. 43–48. Attenuating member 910 has an inlet end 911 and an outlet end 912, and includes an inner surface 913*a* and an outer surface 913*b*. Inner surface 913*a* defines an annular channel portion 914 and has a first end portion 915, a second end portion 916, and a constricted portion 920 therebetween. Constricted portion 920 includes a converging portion 922, a diverging portion 923 and a throat portion 925 therebetween. Throat portion 925 includes a point of greatest constriction 926.

Converging portion 922 is characterized by a region of rapidly decreasing throat cross-sectional area 927, where the cross-sectional area decreases in the direction from first end portion 915 to the point of greatest constriction 926. Diverging portion 923 is characterized by a region of gradually increasing cross-sectional area 928 where the cross-sectional area increases in the direction from the point of greatest constriction 926 toward second end portion 916.

Figure 44:
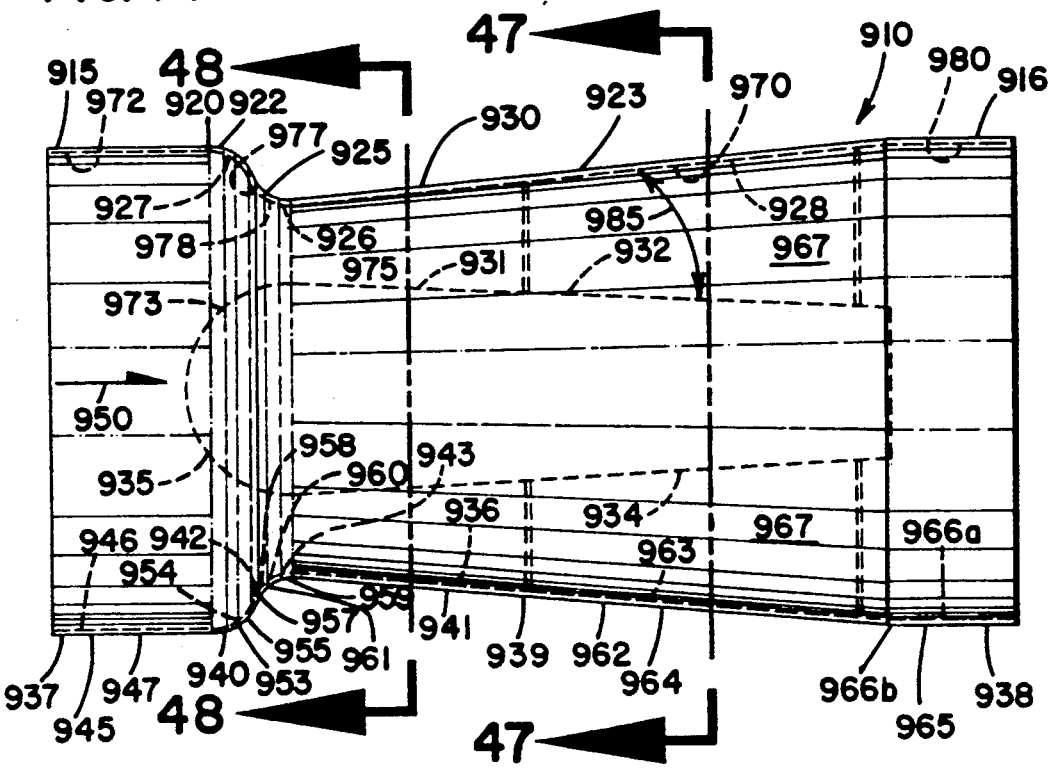
FIG. 44 is a side elevational view of the element in FIG. 43.
Figure 45:
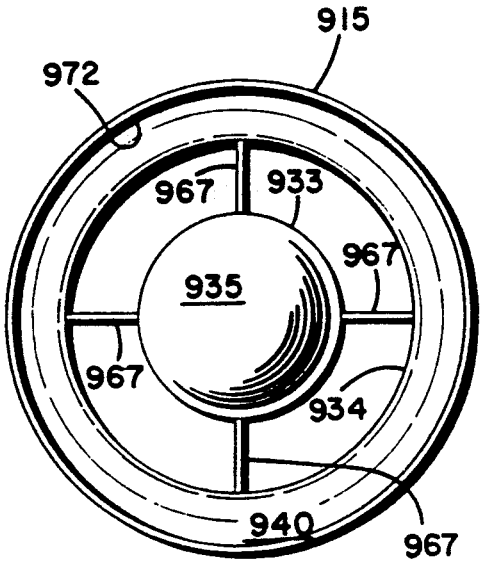
FIG. 45 is an inlet end view as seen from the left end of the element in FIG. 43.
Figure 46:
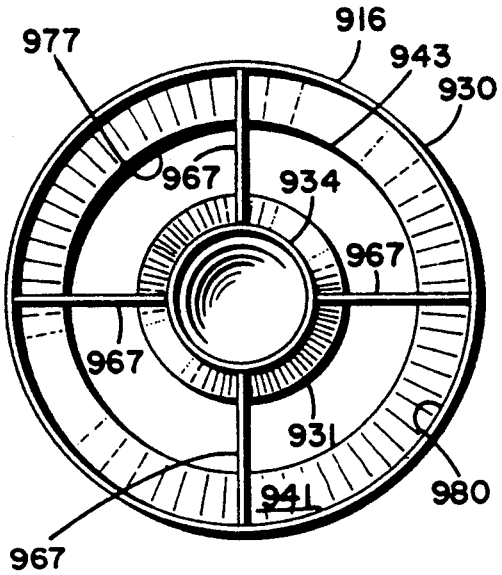
FIG. 46 is an outlet end view as seen from the right end of the element in FIG. 43.
Figure 47:
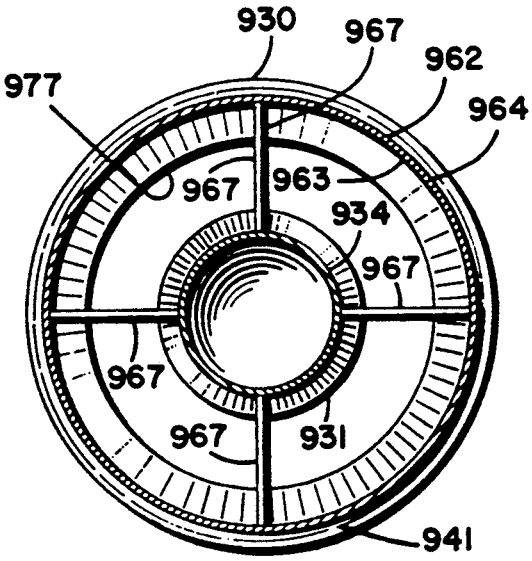
FIG. 47 is a cross-sectional view taken along line 47—47 of FIG. 44.
Figure 48:
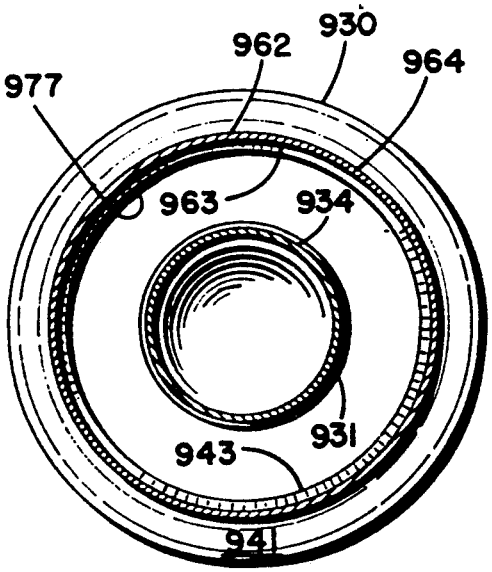
FIG. 48 is a cross-sectional view taken along lines 48—48 of FIG. 44.

Attenuating element 910 includes an outer tubular member 930 and an constricting member 931. As shown in FIG. 44, constricting member 931 has a generally circular periphery with a varying circular cross-sectional area along the length of member 931. Constricting member 931 has an outer-surface 932 and includes a conical portion 934 and a rounded end portion 935.

Outer tubular housing 930 is substantially similar to circular attenuating member 10, described above and shown, for instance, in FIG. 2. That is, tubular housing 930 has an inner surface 936 includes a first end portion 937, a second end portion 938, and a constricted portion 939 therebetween. Constricted portion 939 includes a converging portion 940, a diverging portion 941, and a throat portion 942 therebetween. Throat portion 942 includes a point of greatest constriction 943.

First end portion 937 includes a tubular member 945 having an inner surface 946 and an outer surface 947. Inner surface 946 is generally cylindrical; that is, inner surface 946 is generally circular in cross-section with a constant diameter along the length of inner surface 946 in the direction indicated by arrow 950. (Arrow 950 designates the general direction of flow of a fluid through the attenuating member 910, as will be discussed below.) Outer surface 947 is also generally cylindrical and parallel to inner surface 946; that is, outer surface 947 is generally circular in cross-section with a constant diameter along the length of outer surface 947 in the direction indicated by arrow 950.

Converging portion 940 includes a tubular member 953 having an inner surface 954 and an outer surface 955. Inner surface 954 is convexly curved; that is, inner surface 954 is generally circular in cross section, with a relatively rapidly decreasing diameter along the length of inner surface 954 in the direction indicated by arrow 950. Outer surface 955 is generally parallel to inner surface 954; that is, outer surface 955 is generally circular in cross-section with a relatively rapidly decreasing diameter along the length of outer surface 955 in the direction indicated by arrow 950.

Throat portion 942 includes a tubular member 957 having an inner surface 958 and an outer surface 959. Inner surface 958 is generally circular in cross section and includes a region 960 of least cross-section. Similarly, outer surface 959 is generally circular in cross section and includes a region 961 of least cross-section.

Diverging portion 941 similarly includes a tubular member 962 having an inner surface 963 and an outer surface 964. Inner surface 963 is generally conical; that is, inner surface 963 is generally circular in cross-section with an increasing diameter along the length of inner surface 963 in the direction indicated by arrow 950. Outer surface 964 is generally parallel to inner surface 963 and therefore is generally conical; that is, outer surface 964 is generally circular in cross-section with a linearly increasing diameter along the length of outer surface 964 in the direction indicated by arrow 950.

Second end portion 916 includes a tubular member 965 having an inner surface 966*a* and an outer surface 966*b*. Inner surface 966*a* is generally cylindrical; that is, inner surface 966*a* is generally circular in cross-section with a constant diameter along the length of inner surface 966*a* in the direction indicated by arrow 950.

Cylindrical member 932 is suspended by supports 967 coaxially within tubular housing 930.

Cavity or chamber 970 is generally defined between constricting member outer surface 932 and tubular housing inner surface 936. More specifically, cavity 970 includes a first end channel portion 972 defined by first end tubular member inner surface 946. Channel portion 972 is generally circular in cross-section, having a constant diameter along the length of channel portion 972. Cavity 970 also includes a converging annular channel portion 973 defined between converging portion tubular member inner surface 954 and constricting member rounded end portion 935. Cavity 970 further includes a diverging annular channel portion 975 defined between tubular member diverging portion inner surface 963 and constricting member conical portion 934. Between converging annular channel portion 973 and diverging annular channel portion 975, cavity 970 includes a throat annular channel portion 977 having a point of least cross-sectional area 978. Finally, cavity 970 includes a reattachment channel portion 980 defined by tubular member second end portion inner surface 966*a*. Reattachment channel portion 980 is generally circular in cross-section with a constant diameter along its length.

Preferably, diverging portion 923 diverges at an angle less than that which produces flow separation. Preferably, diverging portion 923 diverges at an angle generally between about 7° and 14°; that is, an angle 985 of between about 3.5° and 7° is defined between diverging portion 923 and constricting member conical portion 934.

VII. SPLITTER ELEMENT EMBODIMENT

An embodiment of a constricted attenuating member 3 which may be used in a dual exhaust system is a splitter attenuating member 1010, shown in FIGS. 49–52. Attenuating member 1010 has an inner surface 1011 and an outer surface 1012 and includes a first inlet end portion 1013, at least two second outlet end portions 1014*a,b*, and a constricted portion 1015 therebetween. Constricted portion 1015 includes a converging portion 1016, a diverging portion 1017 and a throat portion 1018 therebetween. Throat portion 1018 includes a point of greatest constriction 1019.

Converging portion 1016 is characterized by a region of rapidly decreasing throat cross-sectional area 1020, where the cross-sectional area decreases in the direction from first end portion 1013 to the point of greatest constriction 1019. Diverging portion 1017 is characterized by a region of gradually increasing cross-sectional area 1021 where the cross-sectional area increases in the direction from the point of greatest constriction 1019 toward second end portion 1014*a,b*.

Figure 49:
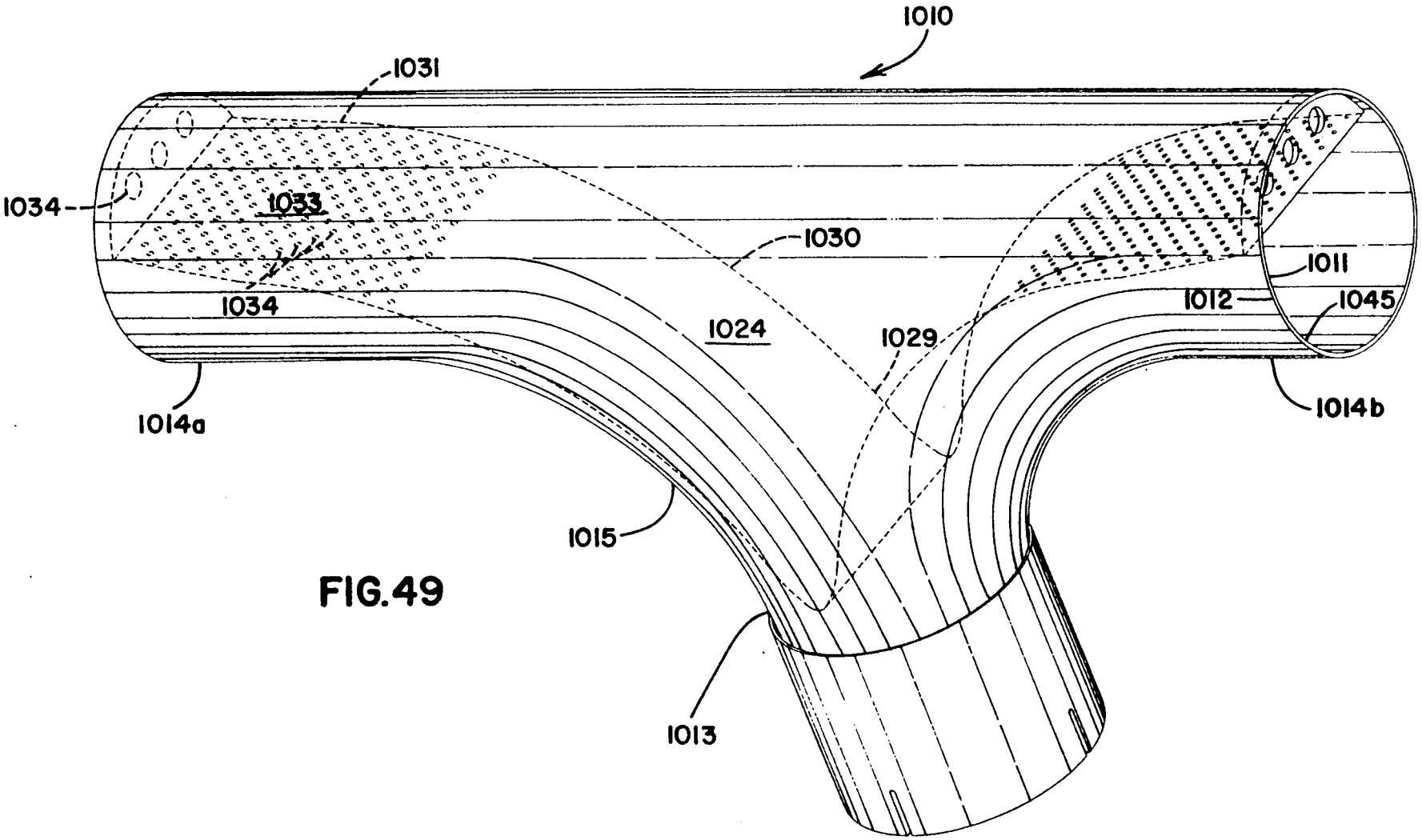
FIG. 49 is a perspective view of an alternative attenuating element to be used to divide a single exhaust pipe into a dual exhaust pipe.
Figure 50:
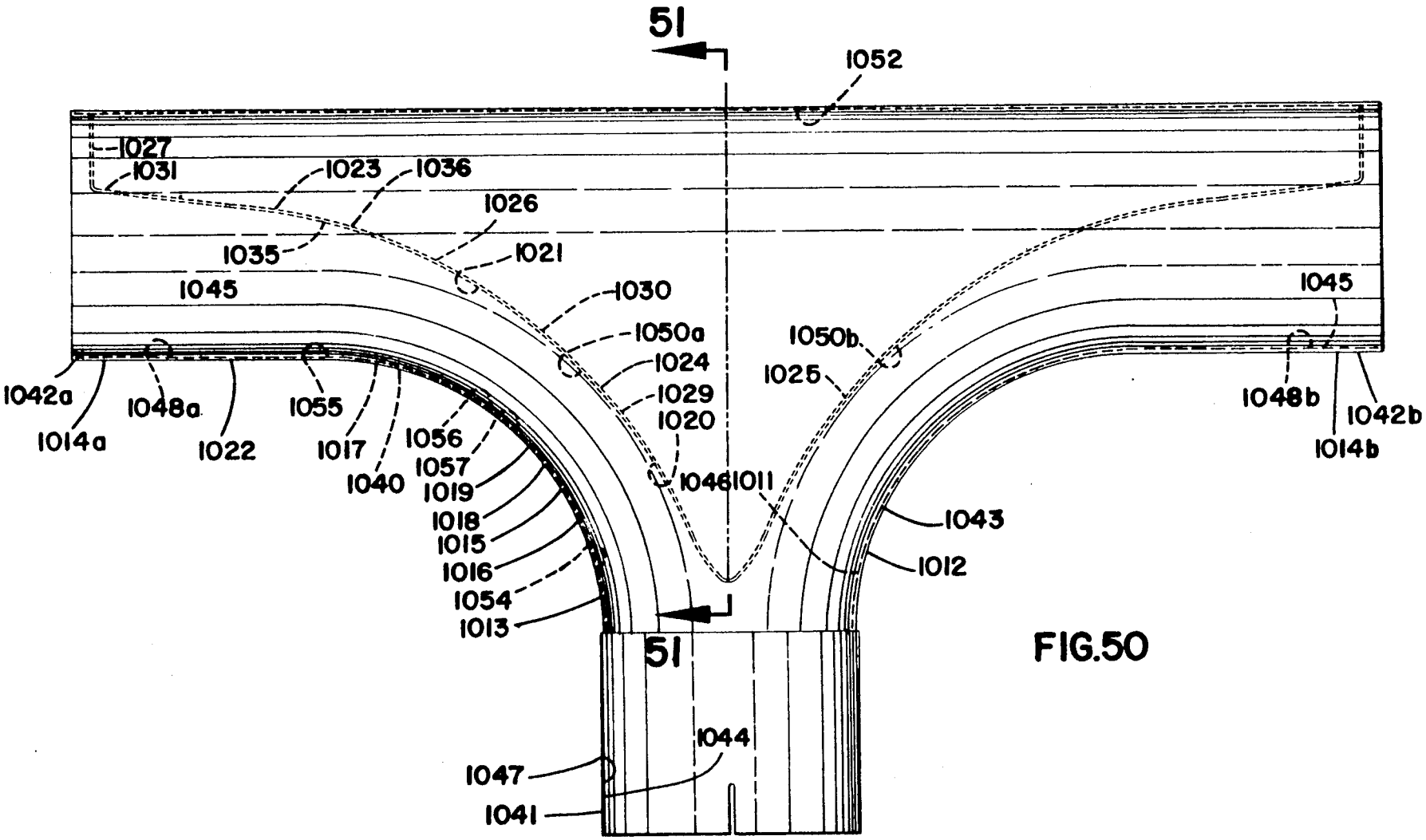
FIG. 50 is a side elevational view of the element in FIG. 49.
Figure 51:
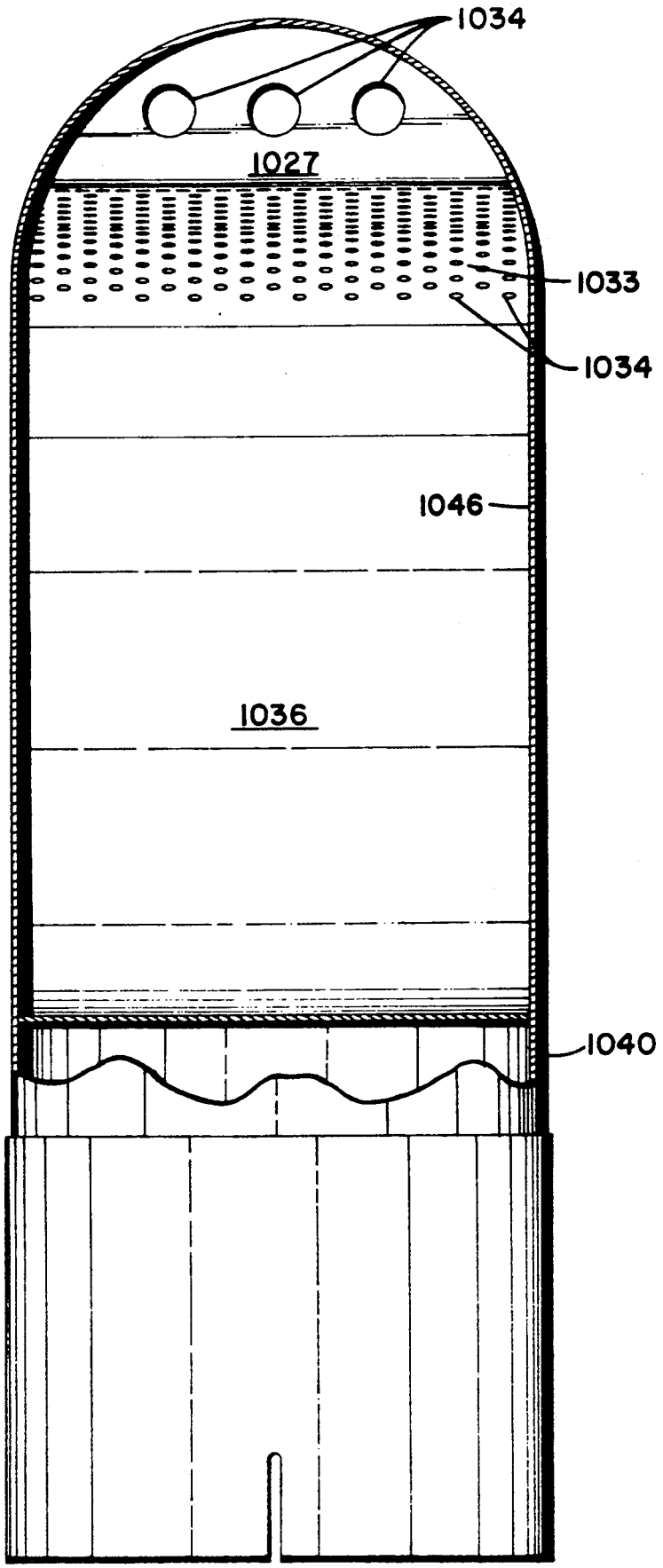
FIG. 51 is a cross-sectional view taken along lines 51—51 of FIG. 50.
Figure 52:
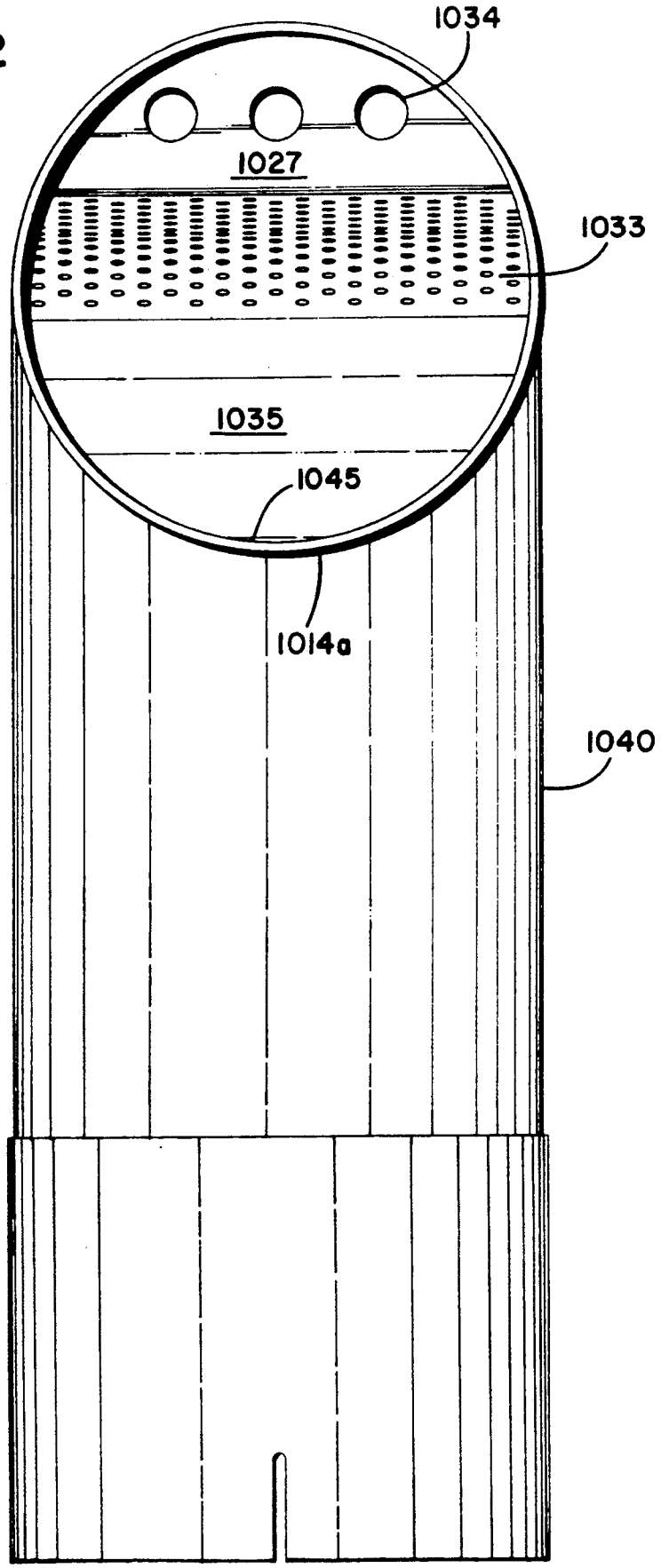
FIG. 52 is an outlet end view as seen from the left side of the element in FIG. 49.

Constricted portion 1015 includes an outer tubular member 1022 and a contoured constricting member 1023. Constricting member 1020 has a first member 1024 with a similar second member 1025 joined thereto. First member 1024 is here described. It is to be understood that second member 1025 is substantially similar. Member 1024 includes a curved portion 1026 and may include a flat portion 1027. Member 1024 is substantially flat across its width. Curved portion 1026 includes a first portion 1029, a second portion 1030 and a third portion 1031. Third portion 1031 preferably has a perforated portion 1032 with perforations 1033, as shown in FIG. 49. Flat portion 1027 includes recesses 1034.

The concave side of first member 1024 includes an inner surface 1035, and the convex side of first member 1024 includes an outer surface 1036, generally parallel to inner surface 1035.

Constricting member 1023 is disposed in a T- or Y-shaped tubular housing 1040 having a cylindrical inlet portion 1041 and at least two cylindrical outlet portions 1042*a,b*, and an intersection portion 1043, therebetween. Inlet portion 1041 has an inner surface 1044; outlet portions 1042*a,b* have inner surfaces 1045*a,b*, respectively, and intersecting portion 1043 has inner surface 1046. An inlet channel 1047 is defined by inlet portion inner surface 1044; outlet channels 1048*a,b* are defined by outlet portion inner surface 1045.

Constricted channels 1050*a,b* are generally defined between constricting member inner surfaces 1035*a,b*, and tubular housing 1040. A cavity or chamber 1052 is generally defined between outer surfaces 1036*a,b* and tubular housing 1040. Channels 1050*a,b* are in fluid communication with cavity 1052 through perforations 1033. Cavity 1052 is in fluid communication with outlet channels 1048*a,b* through openings or apertures 1034. This arrangement of perforations and openings forms a resonator which aids noise attenuation.

Constricted channel 1050*a* will be here described. It is to be understood that constricted channel 1050*b* is substantially similar. Constricted channel 1050*a* includes a converging channel portion 1054, a diverging channel portion 1055, and a throat channel portion 1056 therebetween. Throat channel portion 1056, has a generally semi-circular periphery and includes a point of greatest channel constriction 1057.

Converging channel portion 1054 is defined between first portion 1029 of constricting member curved portion 1026 and tubular housing intersection inner surface 1046. Throat channel portion 1056 is defined between second portion 1030 of constricting member curved portion 1026 and tubular housing intersection inner surface 1046. Diverging channel portion 1055 is defined between third portion 1031 of constricting member curved portion 1026 and tubular housing intersection inner surface 1046.

VIII. ATTENUATING SYSTEM LAYOUT

FIG. 53 shows a portion 2000 of an exhaust system including a connecting pipe portion 2001, a muffler 2002 and a tail pipe portion 2003*a,b*. Connecting pipe portion 2001 and tail pipe portions 2003*a,b* include a plurality of attenuating regions 2005*a–h*. It is to be understood that muffler 2002 may also include attenuating regions 2005.

Attenuating region 2005*d* is described below. It is to be understood that attenuating region 2005*a–c* and 2005*e–h* are substantially similar to attenuating region 2005*d*.

Each attenuating region 2005 has a first end portion 2006, a second end portion 2007, and a constricted portion 2008 therebetween. Each attenuating region 2005 includes an attenuating member 2010. It will be understood that any attenuating element according to this invention, such as those described above, may be incorporated as attenuating member 2010 in this exhaust system portion 2000.

In typical use, gaseous exhaust fluid flows generally in the direction of arrow 2020. Attenuating region 2005*d* generally includes: (1) a converging portion 2022, where the cross-sectional area decreases causing an increase in the flow velocity; (2) a throat portion 2023, wherein the cross-sectional area is at a minimum, resulting in maximum flow velocity; and (3) a diverging portion 2024, where the cross-sectional area increases, resulting in a flow velocity decrease.

Throat portion 2023 includes a point of greatest constriction 2026 which has a cross-sectional area, sized as a function of volumetric flow rate. Diverging portion 2024 diverges at a rate such that flow separation and pressure loss are minimized.

The relative location of the attenuating regions 2005 to each other and to the muffler is determined based on (1) engine noise frequency output and (2) desired attenuation of the system as a function of frequency. In this manner, a muffler-pipe system can be tuned to the frequency bands where attenuation is needed most. Thus, the size of a muffler needed to achieve a given attenuation may be reduced. Alternately, greater attenuation may be achieved with a muffler of a given size.

Each attenuating region 2005 provides a resistance to the oscillating acoustic wave and, therefore, attenuates noise. Relatively high acoustic resistance is obtained with minimal flow resistance due to the shape of converging portion 2022 and the diverging portion 2024.

Further, when two or more attenuating regions 2005 are arranged in series within a tubular housing 2011, the diverging portion 2024 of a first attenuating portion 2005 and the converging portion 2022 of a second attenuating portion 2005 form an expansion chamber 2030 within the tubular housing 2011 itself. This contributes to acoustic attenuation. Preferably, the length of an expansion chamber 2030 is approximately $\frac{1}{4}$ of the wave length of the center frequency to be attenuated.

According to this invention, it is not essential that the tubular housing 2011 be cylindrical or of continuous cross-sectional area. The tubular housing 2011 may include a constricted angular bend or a generally T- or Y-shaped juncture, as described above. Further, attenuating region 2005 may be integral with the tubular housing 2011; that is, this invention is not limited to a separate attenuating member 2010 disposed within the tubular housing 2020. According to this invention, tubular housing 2011 may include an integral constricted portion 2008.

Numerous characteristics and advantages of the invention have been set forth in the foregoing description, together with the details of the structure and function of the invention. The novel features thereof are pointed out in the claims. The disclosure, however, is illustrative only, and changes may be made in detail, especially in matters of shape, size and arrangement of parts, within the principle of the invention, to the full extent indicated by the broad general meanings of the terms in which the appended claims are expressed.

What is claimed is:

1. A sound attenuating device comprising:

(a) a tubular housing having an inlet end and at least two outlet ends, with a generally T-shaped intersection portion between the inlet and outlet ends; and (b) a constricting member having inner and outer surfaces disposed within said housing and located at said T-shaped intersection portion, and said constricting member being constructed and arranged within said housing such that a constricted channel is defined between said inlet and outlet ends by said tubular housing and said constricting member outer surface, said channel including a converging portion toward said inlet end and a diverging portion toward said outlet end and a throat portion having a point of maximum constriction, said constricting member being disposed in said T-shaped intersection portion such that a cavity is defined between said housing and said inner surface of said constricting member, and said constricting member including perforations allowing fluid communication between said cavity and said channel.

* * * * *